US007625181B2

(12) United States Patent
Matsuda et al.

(10) Patent No.: US 7,625,181 B2
(45) Date of Patent: Dec. 1, 2009

(54) TURBINE CASCADE STRUCTURE

(75) Inventors: Hisashi Matsuda, Shinagawa-ku (JP); Asako Inomata, Yokohama (JP); Fumio Otomo, Zama (JP); Hiroyuki Kawagishi, Yokohama (JP); Daisuke Nomura, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 119 days.

(21) Appl. No.: 10/577,651

(22) PCT Filed: Oct. 29, 2004

(86) PCT No.: PCT/JP2004/016461

§ 371 (c)(1),
(2), (4) Date: May 1, 2006

(87) PCT Pub. No.: WO2005/042925

PCT Pub. Date: May 12, 2005

(65) Prior Publication Data

US 2007/0081898 A1 Apr. 12, 2007

(30) Foreign Application Priority Data

Oct. 31, 2003 (JP) ..... 2003-373643

(51) Int. Cl.
*F01D 5/14* (2006.01)
*F01D 9/04* (2006.01)

(52) U.S. Cl. ..... 416/193 A; 416/235; 416/236 R; 416/237; 416/DIG. 2; 415/191; 415/208.2; 415/210.1; 415/211.2; 415/914

(58) Field of Classification Search ..... 415/191, 415/208.1, 208.2, 209.4, 210.1, 211.2, 914; 416/193 A, 223 A, 235, 236 R, 237, 243, 416/DIG. 2
See application file for complete search history.

(56) References Cited

U.S. PATENT DOCUMENTS 2,788,172 A * 4/1957 Stalker ..... 416/223 A (Continued)

FOREIGN PATENT DOCUMENTS

JP 52 68610 6/1977

(Continued)

OTHER PUBLICATIONS

Shin, T. I-P et al., "Controlling Secondary-Flow Structure by Leading-Edge Airfoil Fillet and Inlet Swirl to Reduce Aerodynamic Loss and Surface Heat Transfer", Proceedings of ASMS Turbo Expo, 2002.

*Primary Examiner*—Christopher Verdier
(74) *Attorney, Agent, or Firm*—Oblon, Spivak, McClelland, Maier & Neustadt, L.L.P.

(57) ABSTRACT

A turbine blade cascade structure includes a plurality of blades arranged in series in a circumferential direction on a wall surface, in which a corner portion defined by the wall surface and a front edge portion of each of blade bodies supported by the wall surface, to which a working fluid flows, includes a cover portion (fillet) that extends toward an upstream side of a flow of the working fluid. The turbine blade cascade structure is capable of reducing the secondary flow loss of the secondary flow in spite of the fluctuation of an incident angle of the working fluid flowing to the front edge portion of the blade body.

12 Claims, 20 Drawing Sheets

U.S. PATENT DOCUMENTS

| | | | | |
|---|---|---|---|---|
| 3,843,279 | A * | 10/1974 | Crossley et al. | 415/191 |
| 3,959,966 | A * | 6/1976 | Pearce et al. | 60/796 |
| 4,208,167 | A * | 6/1980 | Yasugahira et al. | 415/210.1 |
| 6,419,446 | B1 | 7/2002 | Kvasnak et al. | |
| 6,422,819 | B1 * | 7/2002 | Tsai et al. | 416/235 |
| 6,851,924 | B2 * | 2/2005 | Mazzola et al. | 415/115 |
| 2002/0182067 | A1 * | 12/2002 | Tiemann | 415/173.1 |

FOREIGN PATENT DOCUMENTS

| | | |
|---|---|---|
| JP | 55-142909 | 11/1980 |
| JP | 73304/1982 | 5/1982 |
| JP | 61-252838 | 11/1986 |
| JP | 62-3847 | 1/1987 |
| JP | 63503/1988 | 4/1988 |
| JP | 1-237305 | 9/1989 |
| JP | 4-124406 | 4/1992 |
| JP | 4 279701 | 10/1992 |
| JP | 4-78803 | 12/1992 |
| JP | 5-44691 | 2/1993 |
| JP | 5 156967 | 6/1993 |
| JP | 8 35401 | 2/1996 |
| JP | 9-112203 | 4/1997 |
| JP | 2000-230403 | 8/2000 |

* cited by examiner

TURBINE CASCADE STRUCTURE

TECHNICAL FIELD

The present invention relates to a turbine blade cascade structure, and more particularly, to a turbine blade cascade structure designed to reduce a secondary flow loss of a secondary flow of working fluid by making an improvement with respect to a root portion (blade root portion) and/or a tip portion (blade tip portion) of a blade body.

BACKGROUND ART

Recently, reinforcement of a blade cascade performance of an axial-flow fluid machine including a steam turbine, a gas turbine and the like has been required to be re-examined by reducing a secondary flow loss of a secondary flow of the working fluid, for example.

The secondary flow loss of the secondary flow may cause great loss as serious as the profile loss defined by the configuration of the blade type.

The secondary loss is considered to be caused by the mechanism to be described hereinafter.

FIG. 27 is a conceptual view that explains the mechanism that causes the secondary flow, which is cited from a reference titled "Fundamentals and practice of a gas turbine" (by Miwa, Published on Mar. 18, 1989, Seibundo Shoten, p. 119).

FIG. 27 is an exemplary conceptual view of a turbine nozzle when seen from a rear edge of the blade body.

The working fluid, for example, steam flowing into a flow passage 4 formed between the blade cascade including adjacent blade bodies 1*a* and 1*b*, and wall surfaces 3*a* and 3*b* each supporting tip portions and root portions of the respective blade bodies 1*a* and 1*b* is curved like an arc as it passes through the flow passage 4 so as to further flow into the next blade cascade.

When the working fluid passes through the flow passage 4, a centrifugal force is generated in the direction from a back side 5 of the blade body 1*b* to a front side 6 of the blade body 1*a* adjacent thereto. The static pressure at the front side 6 of the blade body 1*a* is relatively high to make a balance with the centrifugal force. Meanwhile, the static pressure at the back side 5 of the other blade body 1*b* is relatively low as the flow rate of the working fluid is high.

In this case, a pressure gradient occurs in the flow passage 4 from the front side 6 of the blade body 1*a* to the back side 5 of the other blade body 1*b* adjacent thereto. The pressure gradient also occurs around boundary layers at the root portions and the tip portions of the blade bodies 1*a* and 1*b*, respectively.

Because the flow rate of the working fluid at the boundary layer is low and the centrifugal force thereat is small, it is not capable of resisting against the pressure gradient from the front side 6 of the blade body 1*a* to the back side 5 of the adjacent blade body 1*b*. This may generate the secondary flow of the working fluid from the front side 6 to the back side 5 of the blade body 1*b*. The secondary flow partially contains horseshoe vortexes (horseshoe-like vortex) 8*a* and 8*b* generated upon collision of the working fluid against front edges 7*a* and 7*b* of the blade bodies 1*a* and 1*b*, respectively.

Each of the horseshoe vortexes 8*a* and 8*b* flows across the width of the flow passage 4 toward the back side 5 of the adjacent blade body 1*b* in the form of a passage vortex 9, which swirls up the boundary layer while being interfered with a corner vortex 10 at the back side 5 of the adjacent blade body 1*b*. The resultant vortex becomes the secondary flow vortex.

The secondary flow vortex disturbs the main flow (drive fluid) as the cause of the reduction in the blade cascade efficiency.

FIG. 28 is a graph representing a loss derived from the 3-D (three-dimensional) numerical data fluid analysis as to how the secondary flow of the working fluid influences the reduction in the blade cascade efficiency. The vertical axis of the graph represents the height of the blade body, and the horizontal axis of the graph represents a full pressure, respectively.

Observing the 3-D numerical data fluid analysis, it is recognized that the secondary flow from the front side 6 of the blade body 1*a* to the back side 5 of the adjacent blade body 1*b* occurs at the root and the tip sides of the blade, respectively.

As a result of further observation of the 3-D numerical data fluid analysis, it is recognized that the full pressure loss becomes considerably high in the area (areas A and B in FIG. 28) where the secondary flow vortex caused by the passage vortexes 9*a* and 9*b* swirling around the adjacent blade body 1*b* meet the horseshoe vortexes 8*a* and 8*b* generated through collision against the front edges 7*a* and 7*b* of the blade bodies 1*a* and 1*b* to flow along the back side 5.

Various types of technology have been disclosed in Publications of Japanese Patent Application Laid-Open Publication Nos. HEI 1-106903, HEI 4-124406, 9-112203, 2000-230403 with respect to the development of the process for suppressing the reduction in the efficiency of the blade cascade caused by the secondary flow based on the investigation with respect to the mechanism thereof.

The U.S. Patent Publication No. 6,419,446 discloses the process for reducing the secondary flow loss by providing a cusp-like protruding portion in a stagnation area around portions defined by the front edges 7*a* and 7*b* of the blade bodies 1*a* and 1*b* and the wall surfaces 3*a* and 3*b*, respectively to diminish the strength of the passage vortexes 9*a* and 9*b*.

The reference titled "Controlling Secondary-Flow Structure by Leading-Edge Airfoil Fillet and Inlet Swirl to Reduce Aero-dynamic Loss and Surface Heat Transfers" (Proceedings of ASME TURBO EXPO 2002, Jun. 3-6, 2002 Amsterdam the Netherlands, GT-2002-30529) reports that the flow rate of the working fluid flowing to the cusp-like protruding portion provided in the stagnation area around the portion defined by the front edges 7*a* and 7*b* of the blade bodies 1*a* and 1*b* and the wall surfaces 3*a* and 3*b*, respectively, is accelerated, and the thus accelerated flow of the working fluid serves to eliminate the horseshoe vortexes 8*a* and 8*b* so as to diminish the strength of the passage vortexes 9*a* and 9*b*.

The reference describes an effect derived from the cusp-like rounded protruding portion. As the cusp-like protruding portion has a function in forcing the horseshoe vortexes 8*a* and 8*b* away from the front edges 7*a* and 7*b* of the blade bodies 1*a* and 1*b*, the strength of the passage vortexes 9*a* and 9*b* may be diminished, thus reducing the blade cascade loss. However, it also reports that the aforementioned effect may be obtained on the assumption that an edge line (parting line) of the rounded cusp-like protruding portion is required to coincide with a stagnation point (at which the working fluid collides against the front edges of the blade body) of the working fluid.

As the flow rate of the working fluid flowing into the blade bodies 1*a* and 1*b* may vary with the load (output), it is difficult to control an incident angle of the working fluid especially at a time of the start-up operation, the partial load operation, and the like.

There has been a demand to further broaden the scope of the technology disclosed in the U.S. Patent Publication No. 6,419,446 as described above for the purpose of providing the turbine blade cascade capable of reducing the secondary flow loss irrespective of the fluctuation in the flow rate of the working fluid, and discord between the edge line of the rounded cusp-like protruding portion and the stagnation point of the working fluid.

DISCLOSURE OF THE INVENTION

The present invention has been conceived in consideration of the above circumstances, and an object of the present invention is to provide a turbine blade cascade structure capable of reducing a secondary flow loss due to secondary flow even if a flow rate of working fluid caries and incident angle of the working fluid to a front edge of a blade varies accordingly.

In order to achieve the above object, according to the present invention, there is provided a turbine blade cascade structure in which a plurality of blades are provided in series on a wall surface in a circumferential direction, wherein a corner portion between the wall surface and a front edge portion of each of blade bodies supported by the wall surface, to which a working fluid flows is provided with a coating portion that extends to an upstream side of a flow of the working fluid.

In a preferred embodiment of the present invention, at least one of a root side and a tip side of the blade body is provided with the coating portion.

The coating portion may be formed as a protruded portion that is raised from the upstream side to a height direction of the front edge portion of the blade body. The protruded portion may be formed to have a concave curved surface from a base portion at the upstream side to the height direction of the front edge portion of the blade body.

The protruded portion having the concave curved surface may be formed to establish relationships of $L0=(2\text{-}5)H0$ and $H0=(0.5\text{-}2.0)T$, where L0 represents a distance from the base portion to the front edge portion of the blade body, H0 represents a distance from the wall surface to the height direction of the front edge portion, and T represents a thickness of a boundary layer of the working fluid.

The protruded portion having the concave curved surface may be formed into a fan-like configuration that extends to a front side and a back side of the blade body with respect to a stagnation point of the working fluid that collides against the front edge portion of the blade body. The angle θ of a sector of the protruded portion having the fan-like configuration with respect to the stagnation point of the working fluid that collides against the front edge portion of the blade body may be set to be in a range between ±15° and ±60°.

The coating may be formed as a protruded portion that is raised from the upstream side to the height of the front edge portion of the blade body, which is formed by selecting one of a coating connecting piece which has been preliminarily made as an independent member, a machined piece together with the blade body, and a welded deposit.

The blade body may be supported by at least one of the wall surface at a root side of the blade body and the wall surface at a tip side of the blade body.

The blade body is supported by the wall surface at the root side, and the wall surface may include a straight downward inclined surface linearly angled from the front edge portion of the blade body toward the upstream side. The blade body is supported by the wall surface at the root side, and the wall surface may include a downward inclined surface curved from a center of a width of the blade body toward the upstream side of the front edge portion.

The blade body is supported by the wall surfaces at the root side and the tip side, and the wall surfaces may include a downward inclined surface and an upward inclined surface linearly angled from the front edge portions at the root and the tip sides toward the upstream side. The blade body is supported by the wall surfaces at the root side and the tip side of the blade body, and the wall surfaces may include downward and upward inclined curved surfaces curved from a center of a width of the blade body toward the upstream side of the front edge portion.

The blade body is supported by the wall surfaces at the root side and the tip side, and the wall surface for supporting the blade body at the root side may include a downward inclined curved surface curved from the center of the width of the blade body to the upstream side of the front edge portion, and the wall surface for supporting the blade body at the tip side may include an upward inclined surface linearly angled to extend from the front edge portion of the blade body toward the upstream side.

The wall surface for supporting the blade body may be structured to be flat.

In the turbine blade cascade structure according to the present invention, a corner portion defined by the blade body and the wall surface is provided with a coating having a cross section formed as a protruded portion to form a curved surface. The base portion of the protruded portion is extended to the upstream side to increase the surface area. The flow rate of the working fluid flowing to the curved protruded portion with an enlarged surface area is accelerated to suppress generation of the horseshoe vortex from the front edge of the blade body.

The blade cascade structure of the present invention may be applied to the rotor blade of the turbine and stationary blade (turbine nozzle), and allowed to further reduce the secondary flow loss by diminishing the strength of the passage vortex through the flow of the working fluid.

The present invention will be described in more detail referring to the preferred embodiment together with the accompanying drawings.

BEST MODE FOR CARRYING OUT THE INVENTION

Figure 1:
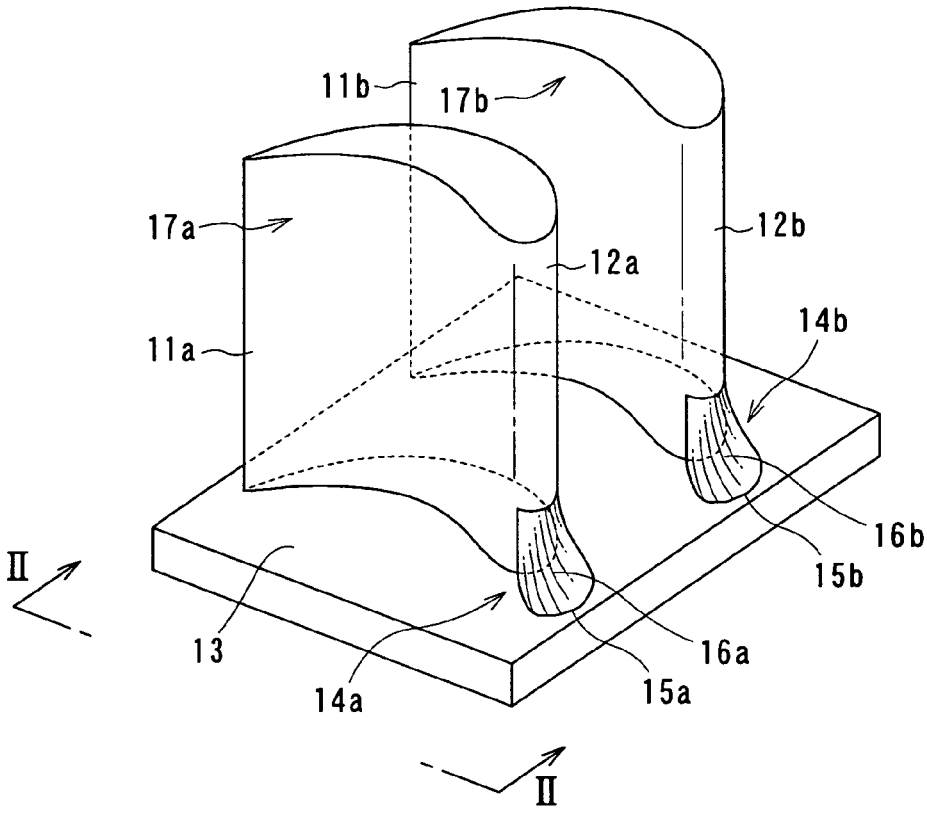
FIG. 1 is a conceptual view of a turbine blade cascade structure according to a first embodiment of the present invention.

A turbine blade cascade structure according to embodiments of the present invention will be described hereunder with reference to the accompanying drawings and reference numerals thereon.

FIG. 1 is a conceptual view of a turbine blade cascade structure according to a first embodiment of the present invention as an example of a turbine rotor blade.

In the turbine blade cascade structure according to the present invention, a plurality of rotor blades are arranged in series to be provided on a substantially flat wall surface 13 like a turbine disc. In the structure, corner (root) portions defined by the wall surface 13 and front edges 12*a* and 12*b* of adjacent blade bodies 11*a* and 11*b* circumferentially arranged in series are provided with coatings (fillets) 14*a* and 14*b* which extend toward the upstream of the working fluid from the front edges 12*a* and 12*b*, respectively.

The coatings (fillets) 14*a* and 14*b* are provided to cover the corner portions of the front edges 12*a* and 12*b* of the blade bodies 11*a* and 11*b*, respectively.

Figure 2:
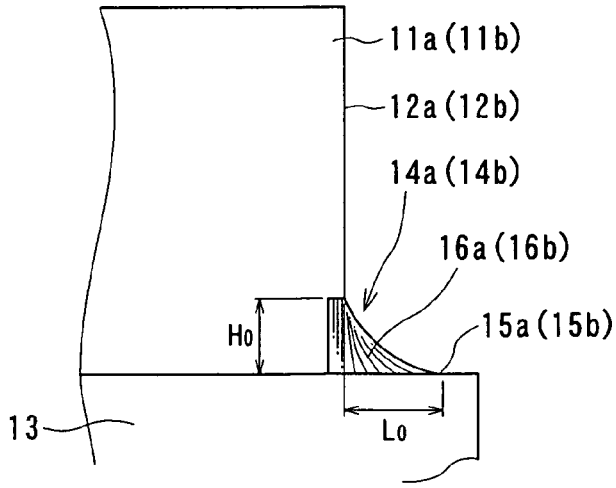
FIG. 2 is a side view of the turbine blade cascade structure seen from a direction II-II shown in FIG. 1.

Referring to FIG. 2, the coatings 14*a* and 14*b* have cross sections formed as protruded portions 16*a* and 16*b* raised from extended end portions 15*a* and 15*b* upstream of the working fluid on the wall surface 13 to heights of the front edges 12*a* and 12*b* of the blade bodies 11*a* and 11*b*. The protruded portions 16*a* and 16*b* may be formed of one of coating connecting pieces which have been preliminarily made as independent members, machined pieces together with the blade bodies 11*a* and 11*b*, and welded deposits.

Assuming that each distance from the extended end portions 15*a* and 15*b* of the coatings 14*a* and 14*b* with cross sections formed as the protruded portions 16*a* and 16*b* to form concave curved surfaces to the front edges 12*a* and 12*b* is set to L0, and each distance from the wall surface 13 to the heights of the front edges 12*a* and 12*b* is set to H0, the relationship of L0=(2-5)H0 is established. The distance H0 is set in consideration for a thickness T of the boundary layer so as to establish the relationship of H0=(0.5-2.0)T.

In the embodiment, the corner portions of the front edges 12*a* and 12*b* of the blade bodies 11*a* and 11*b* are provided with the coatings 14*a* and 14*b* which extend therefrom toward the upstream side of the working fluid and have cross sections formed as the protruded portions 16*a* and 16*b* each raised to the heights of the front edges 12*a* and 12*b* to form the concave curved surfaces. The flow rate of the working fluid flowing to the coatings 14*a* and 14*b* is accelerated to suppress generation of the horseshoe vortex. Accordingly the secondary flow loss may further be reduced by diminishing the strength of the passage vortex.

Figure 3:
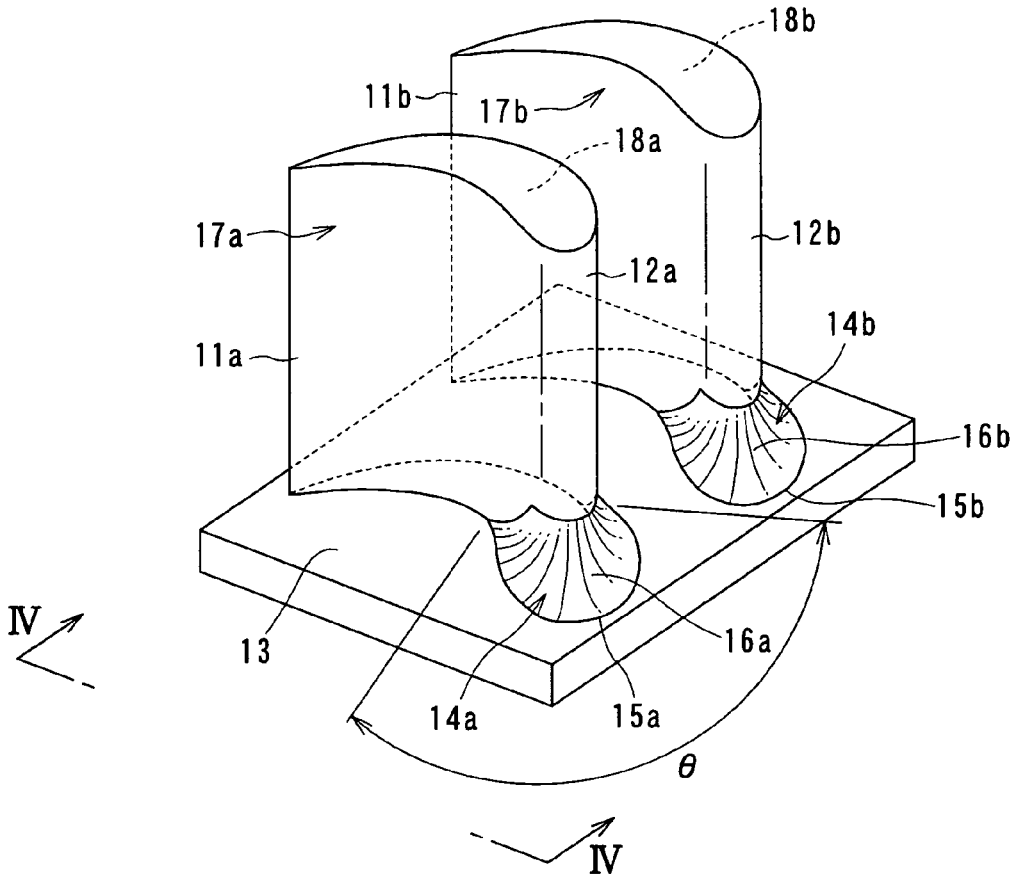
FIG. 3 is a conceptual view of a turbine blade cascade structure according to a second embodiment of the present invention.
Figure 4:
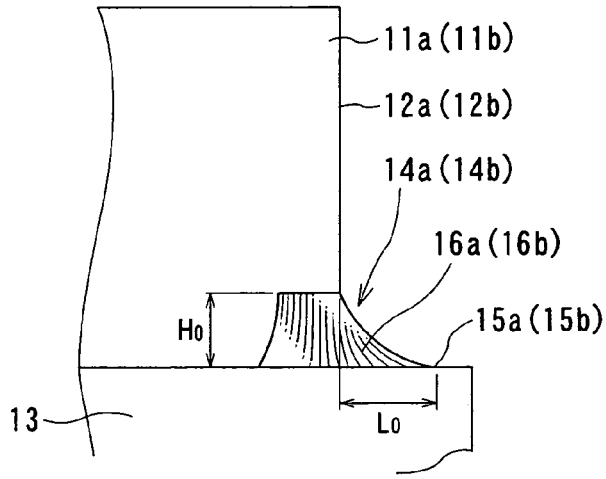
FIG. 4 is a side view of the turbine blade cascade structure seen from a direction IV-IV shown in FIG. 3.

FIGS. 3 and 4 are conceptual views of a turbine blade cascade structure according to a second embodiment of the present invention as an example of a turbine rotor blade.

Elements which are the same as those constituting the first embodiment will be designated with the same reference numerals.

Likewise the first embodiment, in the turbine blade cascade structure according to the embodiment, the corner portion defined by the wall surface 13 like a turbine disc having a substantially flat surface, and the front edges 12*a* and 12*b* of the adjacent blade bodies 11*a* and 11*b* arranged in series circumferentially on the wall surface is provided with coatings (fillets) 14*a* and 14*b* which extend therefrom toward the upstream side of the working fluid. The coatings 14*a* and 14*b* have fan-like configurations extending from the front edges 12*a* and 12*b* toward the front sides 17*a* and 17*b*, and the back sides 18*a* and 18*b* of the blade bodies 11*a* and 11*b*, respectively.

Assuming that each angle of a sector the fan-like configurations of the coatings 14*a* and 14*b* having each side extending toward the front sides 17*a* and 17*b*, and the back sides 18*a* and 18*b* of the blade bodies 11*a* and 11*b*, respectively, from a stagnation point (at which the working fluid collides against the front edge) as a base point is designated as θ, the angle θ is set to be in the range between ±15° and ±60°, that is, $\pm 15° \leqq \theta \leqq \pm 60°$.

Likewise the first embodiment, the fan-like coatings 14*a* and 14*b* have cross sections formed as the protruded portions 16*a* and 16*b* each raised from the extended end portions 15*a* and 15*b* on the wall surface 13 to the heights of the front edges 12*a* and 12*b* of the blade bodies 11*a* and 11*b* to form the concave curved surfaces. The protruded portions 16*a* and 16*b* may be formed of one of coating connecting pieces which have been preliminarily made as independent members, machined pieces together with the blade bodies 11*a* and 11*b*, and welded deposits.

Likewise the first embodiment, assuming that each distance from the extended end portions 15*a* and 15*b* of the coatings 14*a* and 14*b* with cross sections formed as the protruded portions 16*a* and 16*b* to form the concave curved surfaces to the front edges 12*a* and 12*b* is set to L0, and each distance from the wall surface 13 to the heights of the front edges 12*a* and 12*b* is set to H0, the relationship of L0=(2-5) H0 is established. The distance H0 is set in consideration for a thickness T of the boundary layer so as to establish the relationship of H0=(0.5-2.0)T.

In the embodiment, the front edges 12*a* and 12*b* of the blade bodies 11*a* and 11*b* are provided with the coatings 14*a* and 14*b* having cross sections formed as the protruded portions 16*a* and 16*b* raised to the heights of the front edges 12*a* and 12*b* to form the concave curved surfaces. The coatings 14*a* and 14*b* are formed to have fan-like configurations to cope with the extensive fluctuation of the incident angle of the working fluid that flowing to the front edges 12*a* and 12*b* of the blade bodies 11*a* and 11*b*. Then the flow rate of the working fluid flowing to the coatings 14*a* and 14*b* is accelerated while forcing the horseshoe vortex away from the front edges 12*a* and 12*b*. This may suppress generation of the horseshoe vortex, and accordingly the thickness of the boundary layer is decreased. The secondary flow loss may further be reduced by diminishing the strength of the passage vortex.

Figure 5:
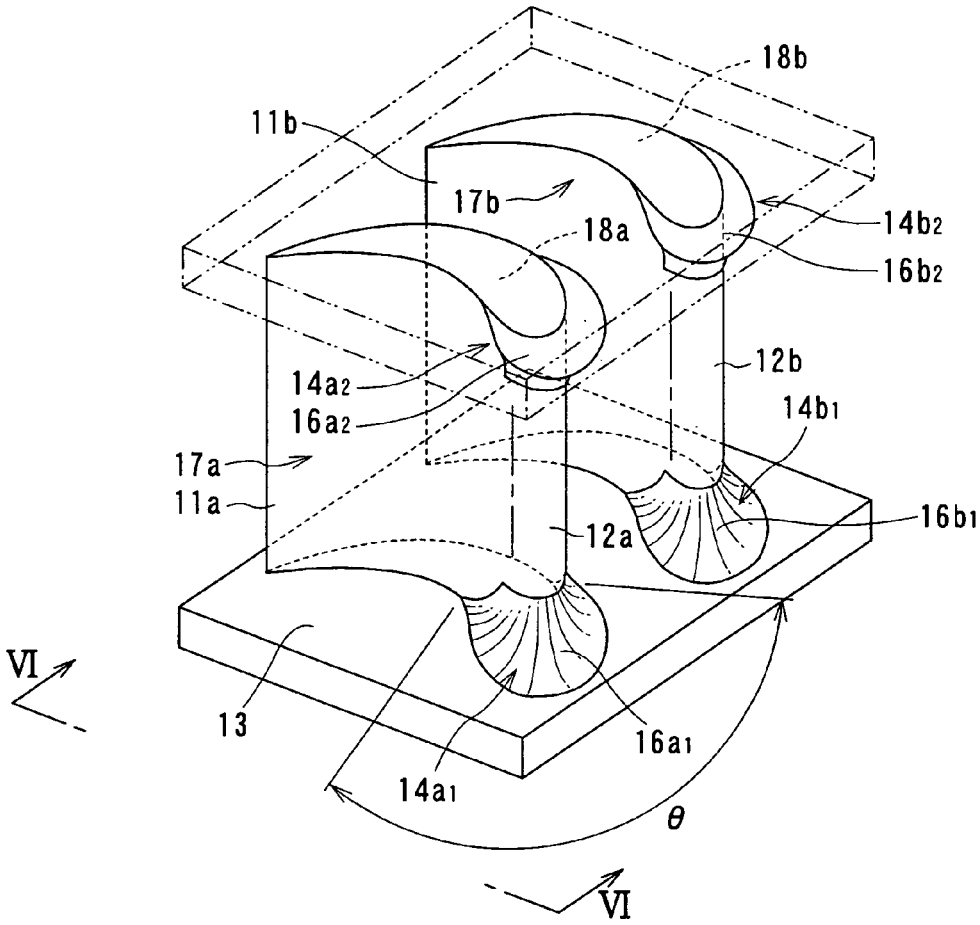
FIG. 5 is a conceptual view of a turbine blade cascade structure according to a third embodiment of the present invention.
Figure 6:
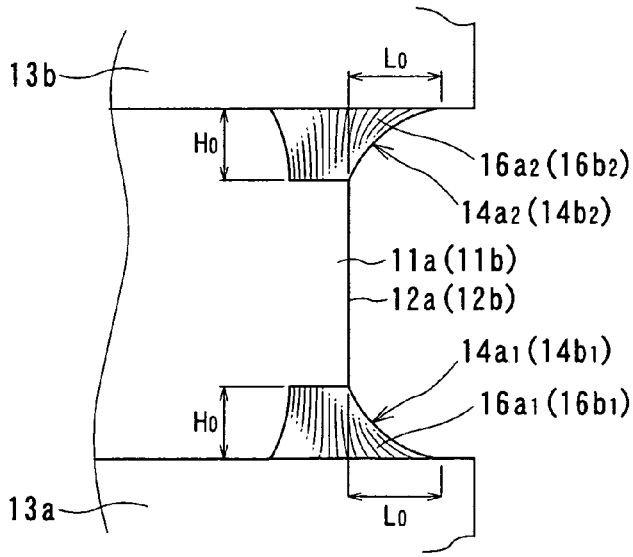
FIG. 6 is a side view of the turbine blade cascade structure seen from a direction VI-VI shown in FIG. 5.

The turbine blade cascade structure according to the embodiment has been applied to the turbine rotor blade. However, it is not limited to the embodiment as described above, and may be applied to the turbine nozzle (stationary blade) as shown in FIGS. 5 and 6.

The turbine nozzle is structured to support the blade bodies 11*a* and 11*b* arranged circumferentially in series between a wall surface 13*b* having a flat face like an outer ring of the diaphragm at the tip side and a wall surface 13*a* having a flat face like an inner ring of the diaphragm at the root side.

Compared with the above structured turbine nozzle (stationary blade), in the blade cascade structure according to the embodiment, fan-like coatings $\mathbf{14}a_1$ and $\mathbf{14}b_1$ are formed at corner portions defined by the wall surface 13*a* and root sides of the front edges 12*a* and 12*b* of the blade bodies 11*a* and 11*b*, and fan-like coatings $\mathbf{14}a_2$ and $\mathbf{14}b_2$ are formed at corner portions defined by the wall surface 13*b* and tip sides of the front edges 12*a* and 12*b* of the blade bodies 11*a* and 11*b*, respectively. Since other elements and portions corresponding thereto in this embodiment are the same as those of the second embodiment, the overlapping explanation will be omitted.

In the embodiment, the front edges 12*a* and 12*b* of the blade bodies 11*a* and 11*b* are provided with coatings $\mathbf{14}a_1$, $\mathbf{14}a_2$, $\mathbf{14}b_1$, $\mathbf{14}b_2$ which extend therefrom at the root and tip sides toward the upstream side, and have cross sections formed as protruded portions $\mathbf{16}a_1$, $\mathbf{16}a_2$, $\mathbf{16}b_1$, $\mathbf{16}b_2$ each raised to heights of the front edges 12*a* and 12*b* to form concave curved surfaces. The coatings $\mathbf{14}a_1$, $\mathbf{14}a_2$, $\mathbf{14}b_1$, and $\mathbf{14}b_2$ are formed to have fan-like configurations to cope with the extensive fluctuation of the incident angle of the working fluid flowing to the front edges 12*a* and 12*b*. The flow rate of the fluid flowing to those coatings $\mathbf{14}a_1$, $\mathbf{14}a_2$, $\mathbf{14}b_1$, and $\mathbf{14}b_2$ is accelerated while forcing the horseshoe vortex away from the front edges 12*a* and 12*b*. Generation of the horseshoe vortex is suppressed to reduce the thickness of the boundary layer. This makes it possible to further reduce the secondary flow loss by diminishing the passage vortex.

Figure 7:
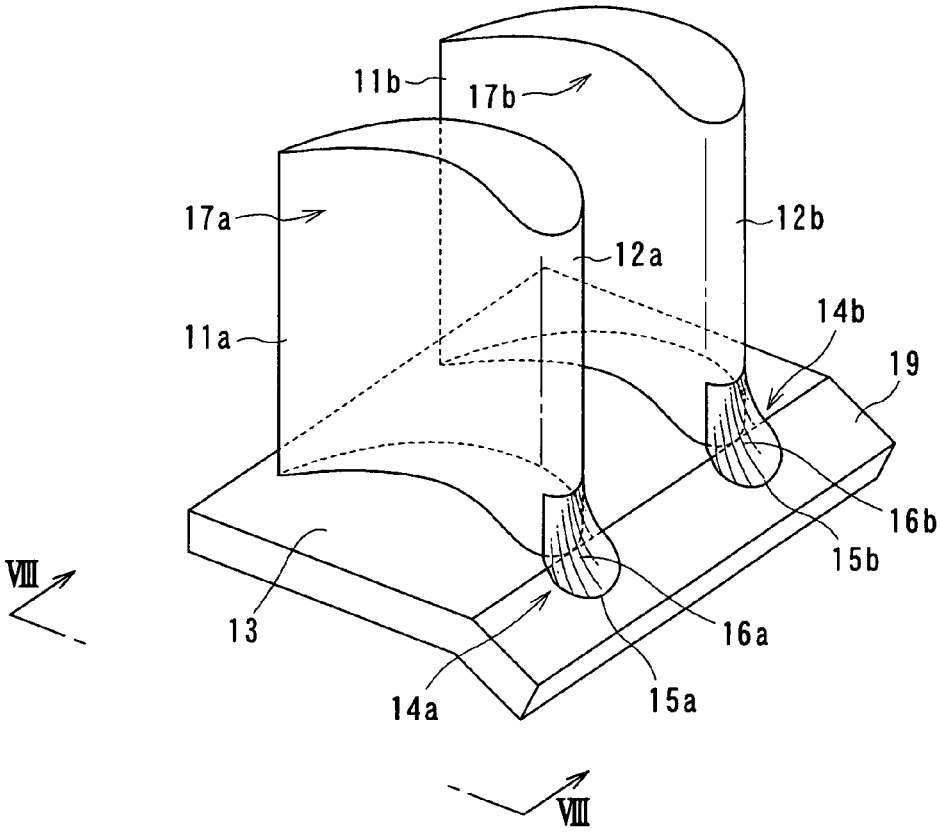
FIG. 7 is a conceptual view of a turbine blade cascade structure according to a fourth embodiment of the present invention.
Figure 8:
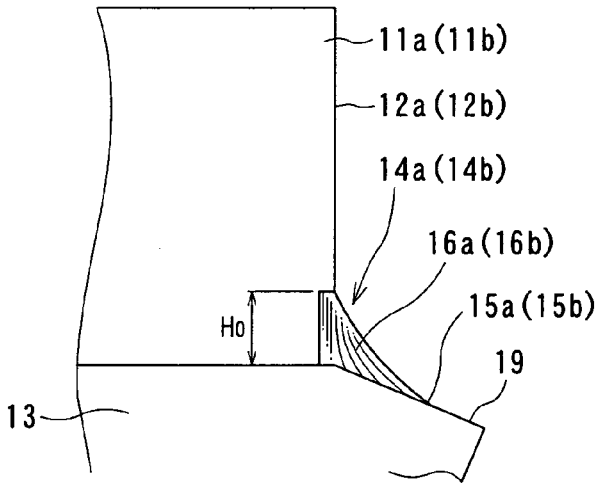
FIG. 8 is a side view of the turbine blade cascade structure seen from a direction VIII-VIII shown in FIG. 7.

FIGS. 7 and 8 are conceptual views of a turbine blade cascade structure according to a fourth embodiment of the present invention as an exemplary turbine rotor blade.

The elements of the embodiment which are the same as those of the first embodiment will be designated with the same reference numerals.

Likewise the first embodiment, in the turbine blade cascade structure of the embodiment, corner (root) portions defined by the wall surface 13 like a turbine disc and the front edges 12*a* and 12*b* of the adjacent blade bodies 11*a* and 11*b* provided on the wall surface 13 are provided with coatings 14*a* and 14*b* which extend therefrom toward the upstream side, and have cross sections formed as the protruded portions 16*a* and 16*b* each raised to the heights of the front edges 12*a* and 12*b* to form the concave curved surfaces. The wall surface 13 for supporting the blade bodies 11*a* and 11*b* includes a downward inclined surface 19 linearly angled to extend from an edge line of the front edges 12*a* and 12*b* toward the upstream side.

Since other elements and portions corresponding thereto in this embodiment are the same as those of the first embodiment, the overlapping explanation will be omitted.

In the embodiment, the front edges 12*a* and 12*b* of the blade bodies 11*a* and 11*b* are provided with coatings 14*a* and 14*b* which laterally extend from the front edges 12*a* and 12*b* toward the upstream side, and have cross sections formed as the protruded portions 16*a* and 16*b* each raised to the heights of the front edges 12*a* and 12*b*. The wall surface 13 for supporting the blade bodies 11*a* and 11*b* includes the downward inclined surface 19 linearly angled so as to extend from the edge line of the front edges 12*a* and 12*b* toward the upstream side. The flow rate of the working fluid flowing to the coatings 14*a*, 14*b*, and the inclined surface 19 is accelerated to suppress generation of the horseshoe vortex. This makes it possible to further reduce the secondary flow loss by diminishing the strength of the passage vortex.

Figure 9:
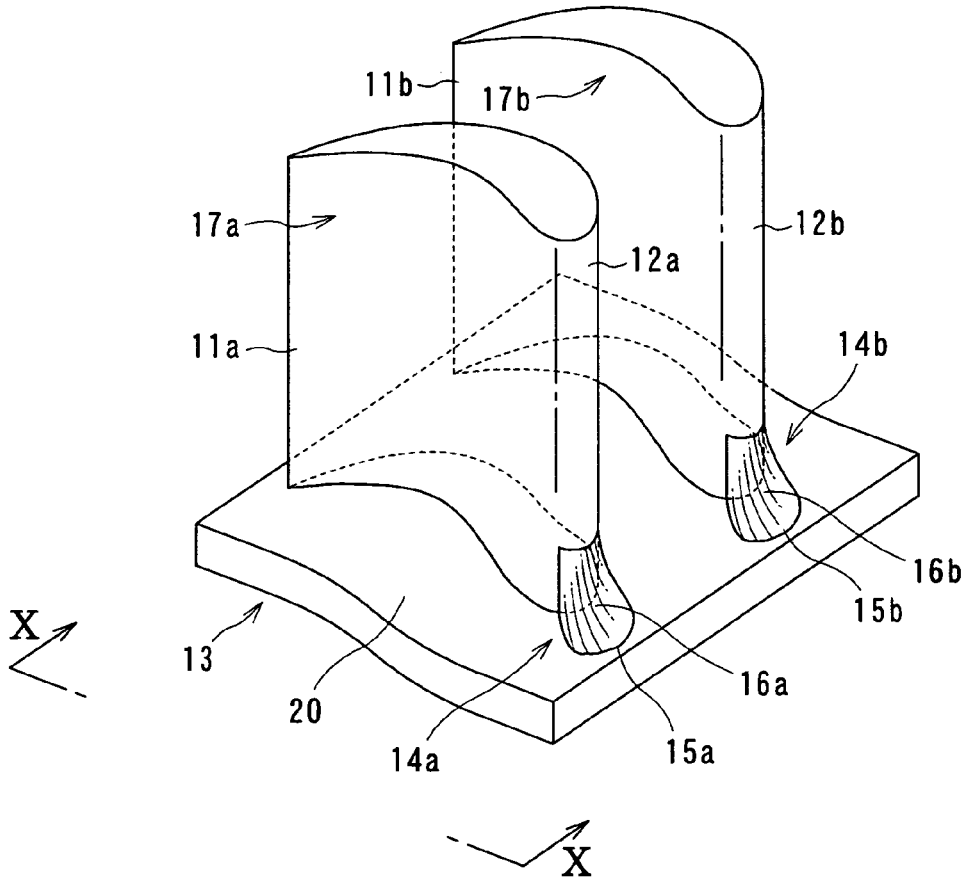
FIG. 9 is a conceptual view of a turbine blade cascade structure according to a fifth embodiment of the present invention.
Figure 10:
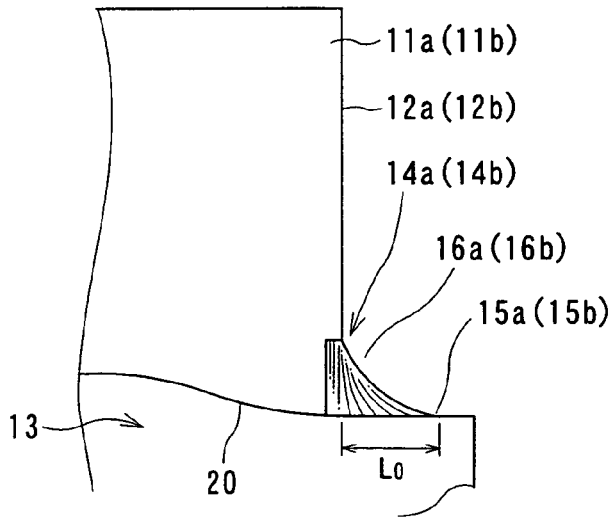
FIG. 10 is a side view of the turbine blade cascade structure seen from a direction X-X shown in FIG. 9.

FIGS. 9 and 10 are conceptual views of a turbine blade cascade structure according to a fifth embodiment of the present invention as an exemplary turbine rotor blade.

The elements of the embodiment which are the same as those of the first embodiment will be designated with the same reference numerals.

Likewise the first embodiment, in the turbine blade cascade structure according to the embodiment, corner (root) portions defined by the wall surface 13 like the turbine disc and the front edges 12*a* and 12*b* of the adjacent blade bodies 11*a* and 11*b* on the wall surface 13 are provided with coatings 14*a* and 14*b* which extend from the front edges 12*a* and 12*b* toward the upstream side, and have cross sections formed as the protruded portions 16*a* and 16*b* each raised to the heights of the front edges 12*a* and 12*b* to form the concave curved surfaces. The wall surface 13 for supporting the blade bodies 11*a* and 11*b* includes a downward inclined curved surface 20 curved from a line passing through each center of the width of the blade bodies 11*a* and 11*b* toward the upstream of the front edges 12*a* and 12*b*.

Since other elements and portions corresponding thereto in this embodiment are the same as those of the first embodiment, the overlapping explanation will be omitted.

In the embodiment, the front edges 12*a* and 12*b* of the blade bodies 11*a* and 11*b* are provided with coatings 14*a* and 14*b* which extend therefrom toward the upstream side, and have cross sections formed as the protruded portions 16*a* and 16*b* each raised to the heights of the front edges 12*a* and 12*b* to form the concave curved surface, for example. The wall surface 13 for supporting the blade bodies 11*a* and 11*b* includes the downward inclined curved surface 20 curved so as to extend from the line passing through each center of the width of the blade bodies 11*a* and 11*b* toward the upstream side of the front edges 12*a* and 12*b*. The flow rate of the working fluid flowing to the coatings 14*a* and 14*b*, and the inclined curved surface 20 is accelerated to suppress generation of the horseshoe vortex. This makes it possible to further reduce the secondary flow loss by diminishing the strength of the passage vortex.

Figure 11:
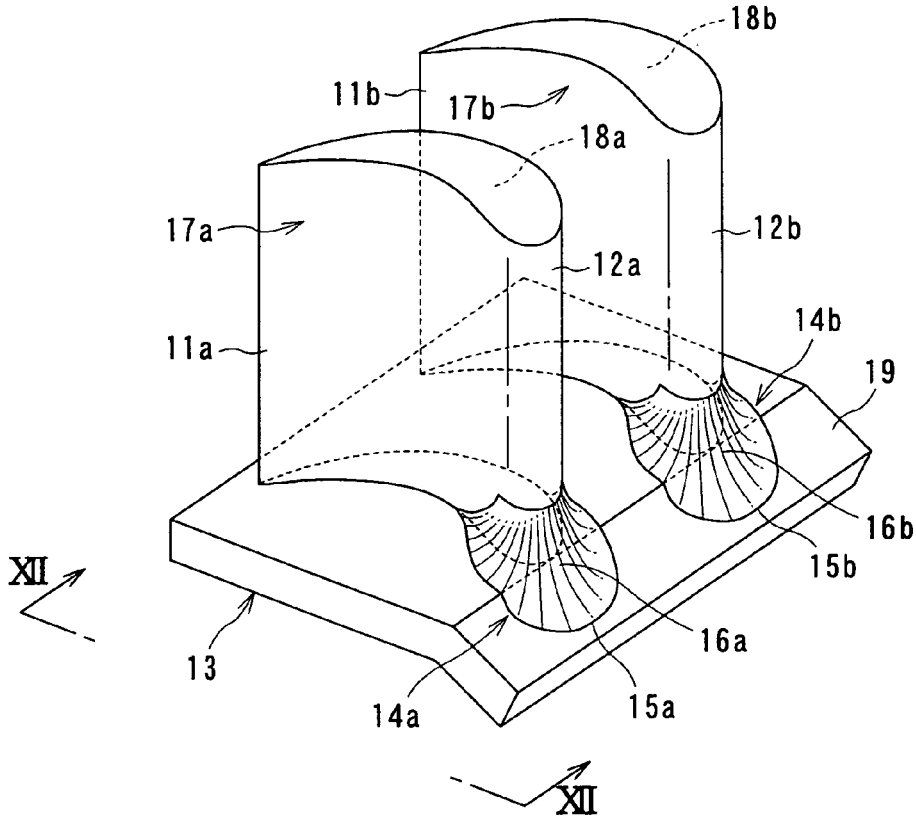
FIG. 11 is a conceptual view of a turbine blade cascade structure according to a sixth embodiment of the present invention.
Figure 12:
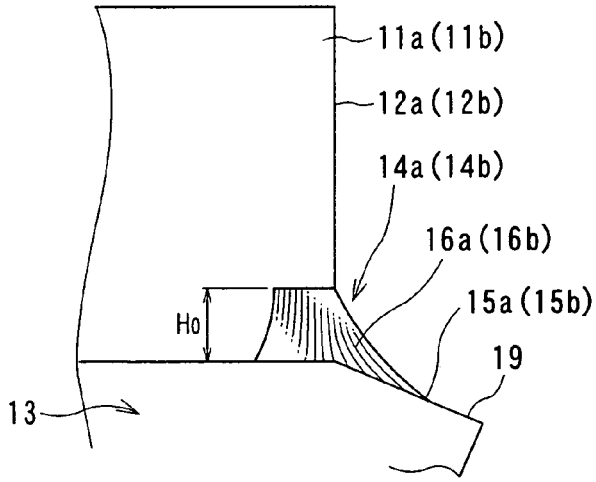
FIG. 12 is a side view of the turbine blade cascade structure seen from a direction XII-XII shown in FIG. 11.

FIGS. 11 and 12 are conceptual views of a turbine blade cascade structure according to a sixth embodiment of the present invention as an exemplary turbine rotor blade.

The elements of the embodiment which are the same as those of the second embodiment will be designated with the same reference numerals.

Likewise the second embodiment, in the turbine blade cascade structure according to the embodiment, the corner portions defined by the wall surface 13 like the turbine disc, and the front edges 12*a* and 12*b* of the adjacent blade bodies 11*a* and 11*b* on the wall surface 13 are provided with fan-like coatings 14*a* and 14*b* which extend from the front edges 12*a* and 12*b* toward the upstream side, and have cross sections formed as the protruded portions 16*a* and 16*b* each raised to the heights of the front edges 12*a* and 12*b* to form the concave curved surfaces. The wall surface 13 for supporting the blade bodies 11*a* and 11*b* has a downward inclined portion 19 linearly angled to extend from the edge line of the front edges 12*a* and 12*b* toward the upstream side.

Since other elements and portions corresponding thereto in this embodiment are the same as those of the second embodiment, the overlapping explanation will be omitted.

In the embodiment, the front edges 12*a* and 12*b* of the blade bodies 11*a* and 11*b* are provided with fan-like coatings 14*a* and 14*b* which extend therefrom toward the upstream side, and have cross sections formed as the protruded portions 16*a* and 16*b* each raised to the heights of the front edges 12*a* and 12*b* to form the concave curved surface, for example. The wall surface 13 for supporting the blade bodies 11*a* and 11*b* includes the downward inclined surface 19 linearly angled so as to extend from the edge line of the front edges 12*a* and 12*b* toward the upstream side. The flow rate of the working fluid flowing to the coatings 14*a* and 14*b*, and the inclined surface 19 is accelerated to force the horseshoe vortex away from the front edges 12*a* and 12*b*. Generation of the horseshoe vortex is suppressed to decrease the thickness of the boundary layer. This makes it possible to further reduce the secondary flow loss by diminishing the strength of the passage vortex.

Figure 13:
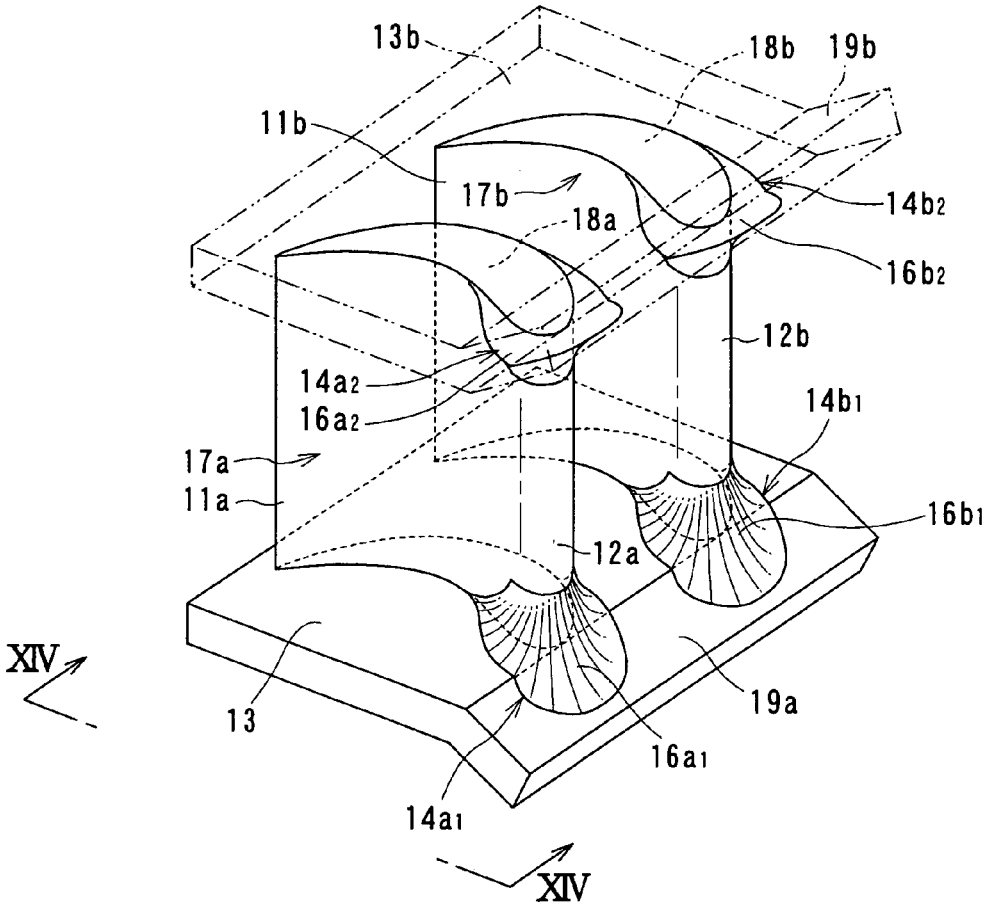
FIG. 13 is a conceptual view of a turbine blade cascade structure according to a seventh embodiment of the present invention.
Figure 14:
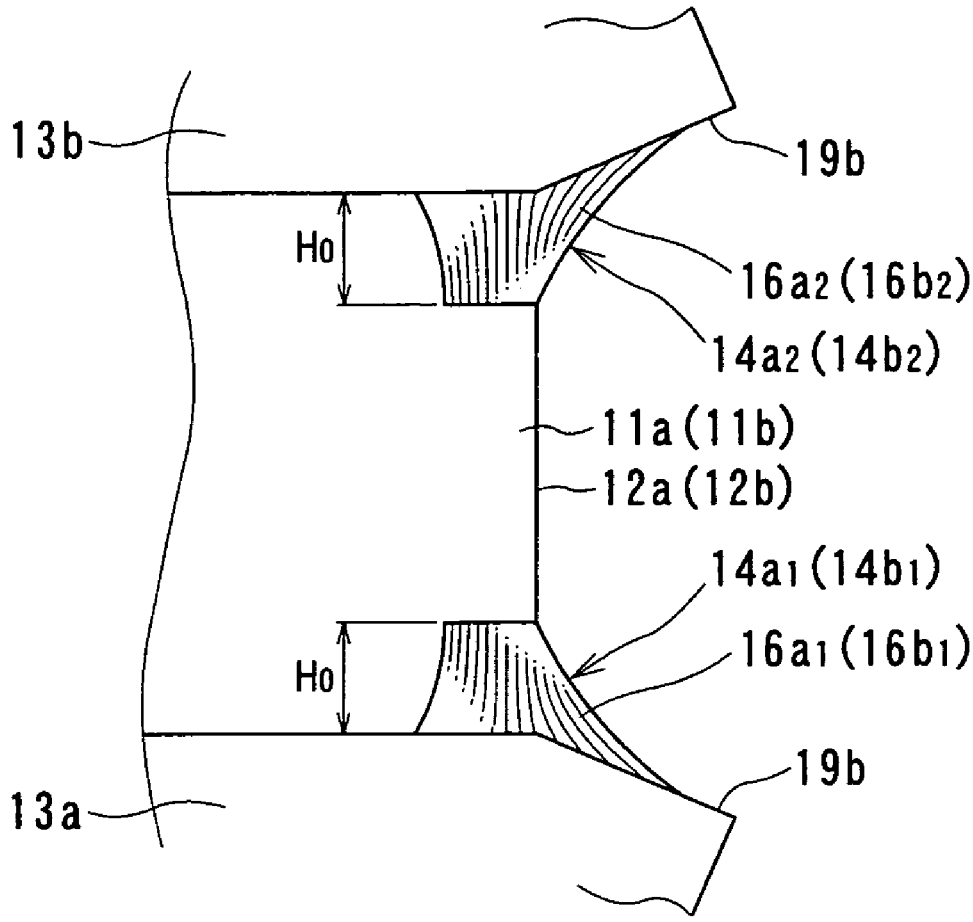
FIG. 14 is a side view of the turbine blade cascade structure seen from a direction XIV-XIV shown in FIG. 13.

FIGS. 13 and 14 are conceptual views of a turbine blade cascade structure according to a seventh embodiment of the present invention as an exemplary turbine nozzle (stationary blade).

The elements of the embodiment which are the same as those of the first and the third embodiments will be designated with the same reference numerals.

Likewise the third embodiment, in the turbine blade cascade structure according to the embodiment, coatings $\mathbf{14}a_1$, $\mathbf{14}a_2$, $\mathbf{14}b_1$ and $\mathbf{14}b_2$ are provided at corner portions defined by wall surfaces 13*a* and 13*b*, and the front edges 12*a* and 12*b* of the blade bodies 11*a* and 11*b* at the tip side and root side in the blade cascade structure which is supported between the wall surface 13*a* of the outer ring of the diaphragm at the tip side of the turbine nozzle and the wall surface 13*b* of the inner ring of the diaphragm at the root side of the turbine nozzle.

The coatings $\mathbf{14}a_1$, $\mathbf{14}a_2$, $\mathbf{14}b_1$, and $\mathbf{14}b_2$ extend from the corner portions of the front edges 12*a* and 12*b* of the blade bodies 11*a* and 11*b* of the turbine nozzle at the tip side and the root side, respectively, and have cross sections formed as protruded portions $\mathbf{16}a_1$, $\mathbf{16}a_2$, $\mathbf{16}b_1$ and $\mathbf{16}b_2$ each raised to the heights of the front edges 12*a* and 12*b* to form the concave curved surfaces, and fan-like configurations to cope with the extensive fluctuation of the incident angle of the working fluid flowing to the front edges 12*a* and 12*b*.

In the embodiment, among the wall surfaces 13*a* and 13*b* for supporting the blade bodies 11*a* and 11*b*, the wall surface 13*a* at the root side includes a downward inclined surface 19*a* linearly angled to extend from the edge line of the front edges 12*a* and 12*b* toward the upstream side, and the wall surface 13*b* at the tip side also includes an upward inclined surface 19*b* linearly angled to extend from the edge line of the front edges 12*a* and 12*b* toward the upstream side, respectively.

Since other elements and portions corresponding thereto in this embodiment are the same as those of the first and the third embodiments, the overlapping explanation will be omitted.

In the embodiment, the front edges 12*a* and 12*b* at the tip and the root sides are provided with fan-like coatings $\mathbf{14}a_1$, $\mathbf{14}a_2$, $\mathbf{14}b_1$, and $\mathbf{14}b_2$ which extend therefrom toward the upstream side, and have cross sections formed as protruded portions $\mathbf{16}a_1$, $\mathbf{16}a_2$, $\mathbf{16}b_1$, and $\mathbf{16}b_2$ each raised to the heights of the front edges 12*a* and 12*b* to form the concave curved surfaces, for example. The coatings $\mathbf{14}a_1$, $\mathbf{14}a_2$, $\mathbf{14}b_1$, and $\mathbf{14}b_2$ are formed to have fan-like configurations to cope with the extensive fluctuation of the incident angle of the working fluid flowing to the front edges 12*a* and 12*b*.

Among the wall surfaces 13*a* and 13*b* for supporting the blade bodies 11*a* and 11*b*, the wall surface 13*a* at the root side includes a downward inclined surface 19*a* linearly angled from the edge line of the front edges 12*a* and 12*b* at the root side toward the upstream side, and the wall surface 13*b* includes an upward inclined surface 19*b* linearly angled to extend from the edge line of the front edges 12*a* and 12*b* at the tip side toward the upstream side. The flow rate of the working fluid flowing to the coatings $\mathbf{14}a_1$, $\mathbf{14}a_2$, $\mathbf{14}b_1$, and $\mathbf{14}b_2$ at the tip and the root sides, and the inclined surfaces 19*a* and 19*b* is accelerated to force the horseshoe vortex away from the front edges 12*a* and 12*b*. Generation of the horseshoe vortex may be suppressed to decrease the thickness of the boundary layer. This makes it possible to further reduce the secondary flow loss at each of the tip and the root sides of the blade bodies 11*a* and 11*b* by diminishing the strength of the passage vortex.

Figure 15:
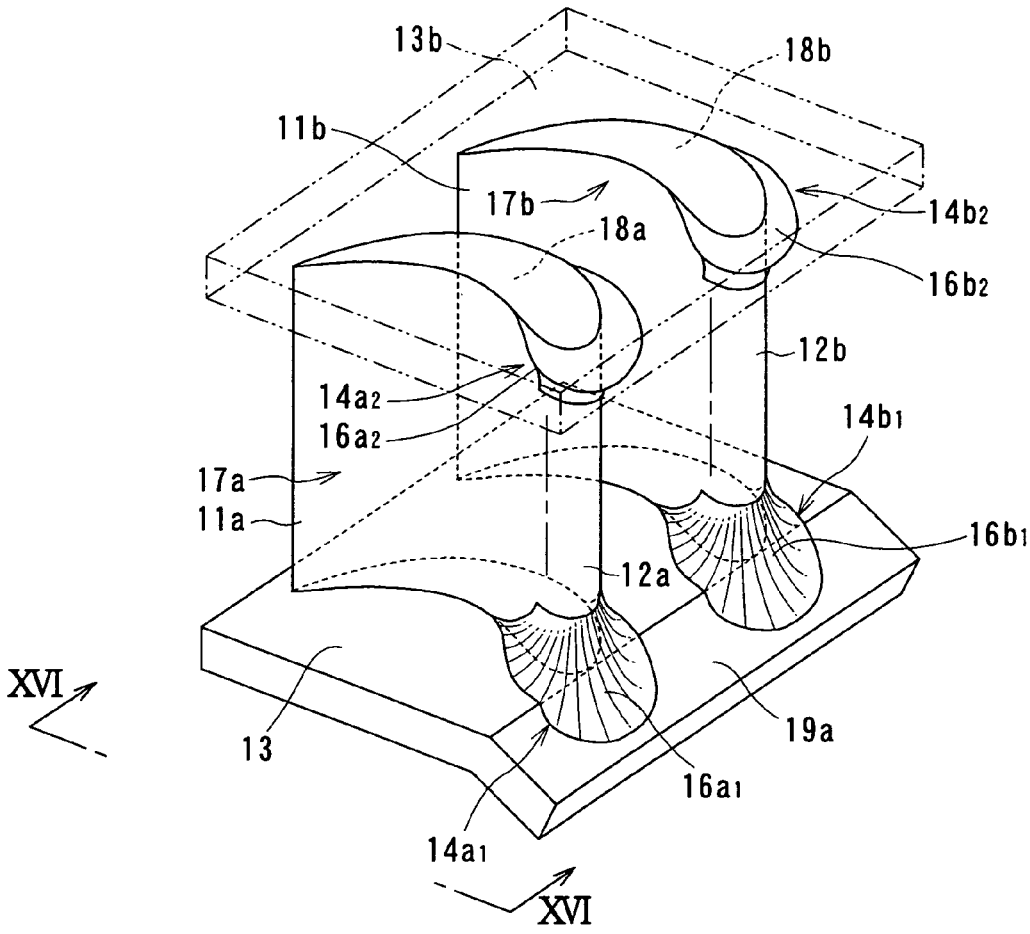
FIG. 15 is a conceptual view of a turbine blade cascade structure according to an eighth embodiment of the present invention.
Figure 16:
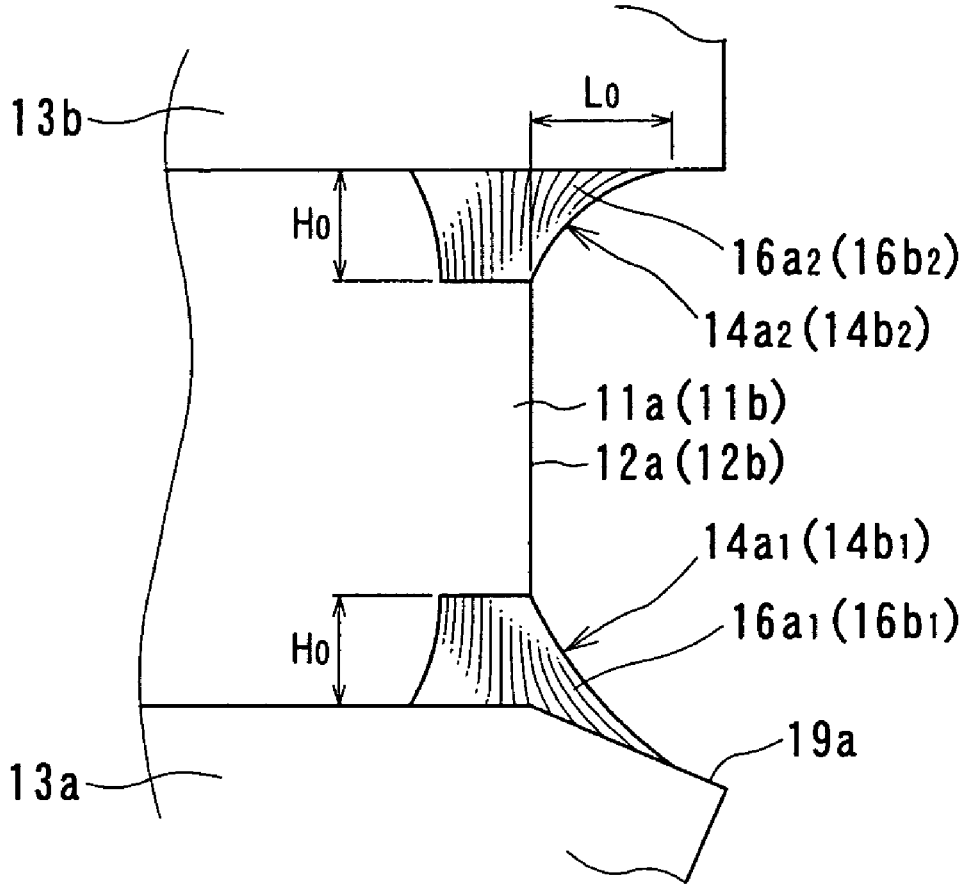
FIG. 16 is a side view of the turbine blade cascade structure seen from a direction XVI-XVI shown in FIG. 15.
Figure 17:
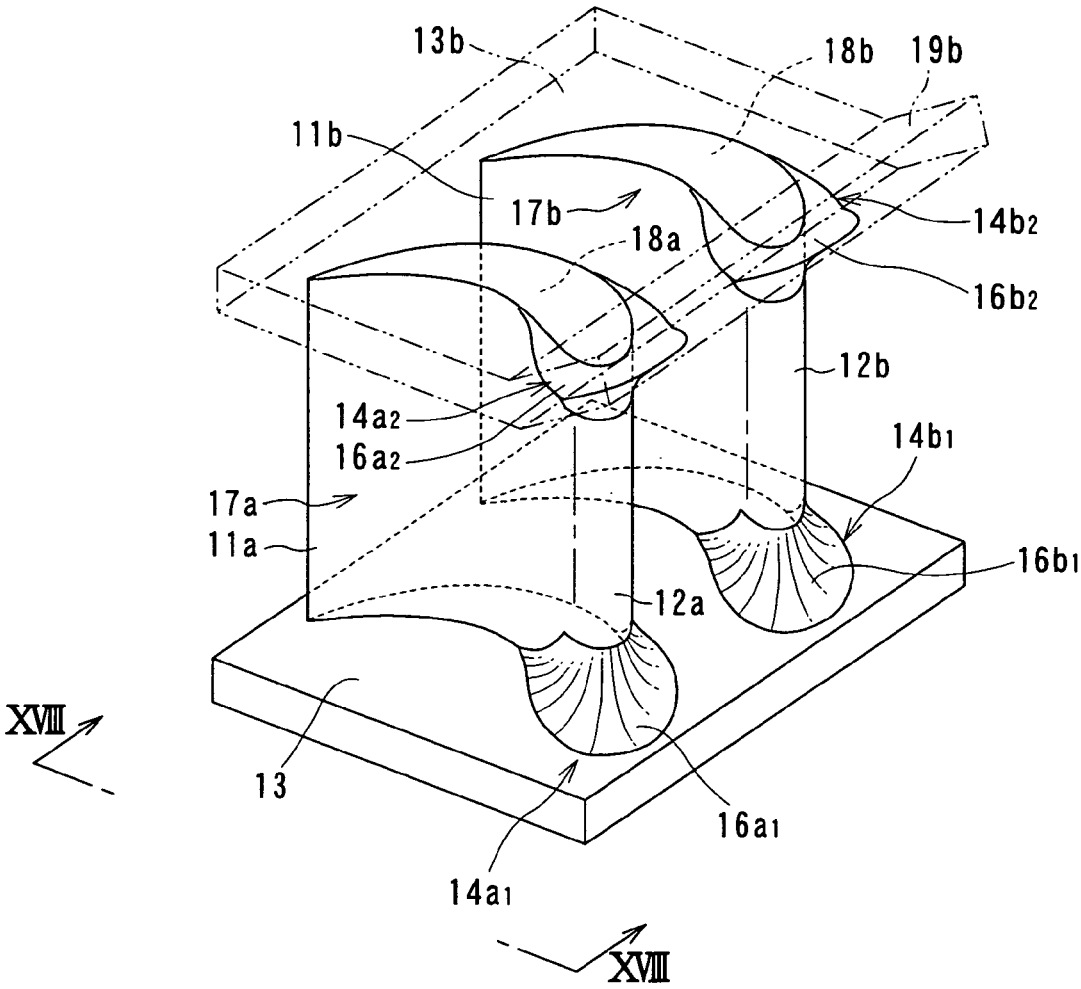
FIG. 17 is a conceptual view of a turbine blade cascade structure according to a ninth embodiment of the present invention.
Figure 18:
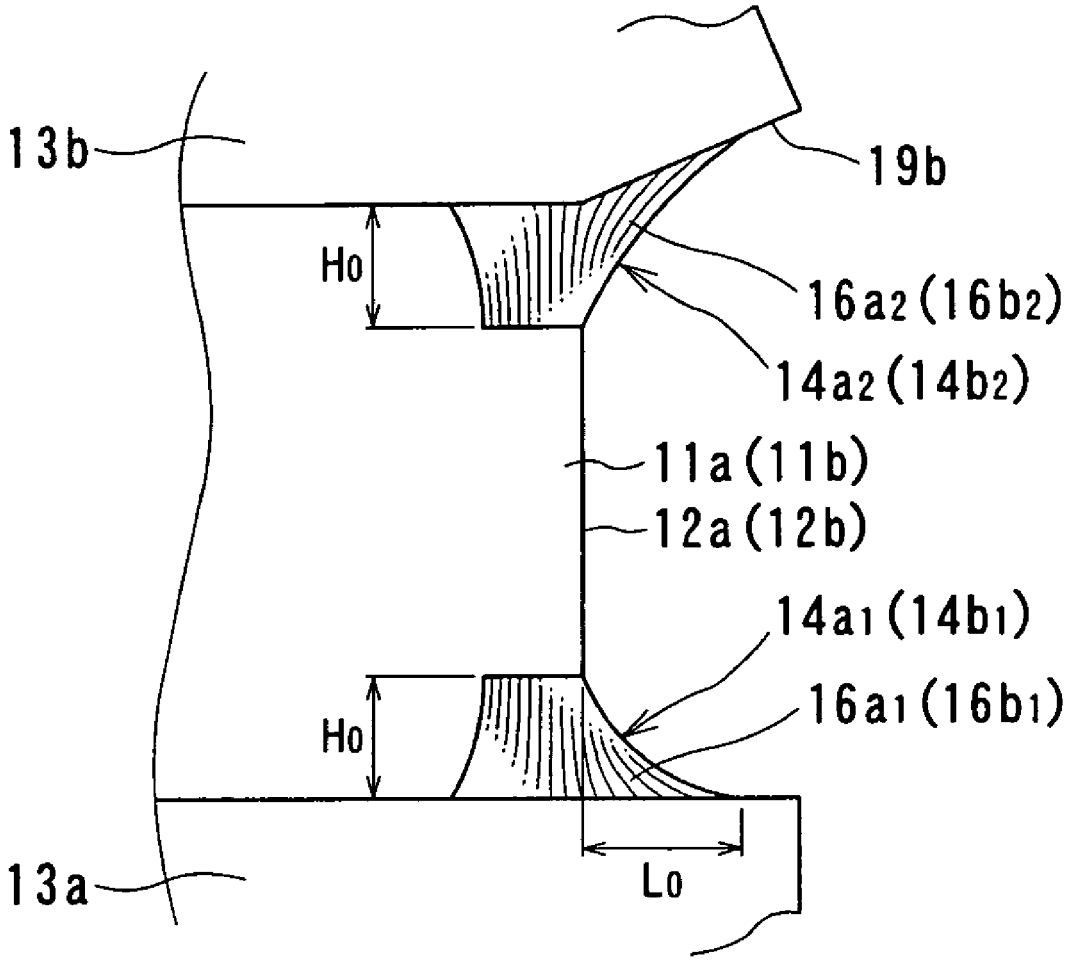
FIG. 18 is a side view of the turbine blade cascade structure seen from a direction XVIII-XVIII shown in FIG. 17.

In the embodiment, among those wall surfaces 13*a* and 13*b* for supporting the blade bodies 11*a* and 11*b*, the wall surface 13*a* at the root side includes a downward inclined surface 19*a* linearly angled to extend from the edge line of the front edges 12*a* and 12*b* toward the upstream side, and the wall surface 13*b* at the tip side includes an upward inclined surface 19*b* linearly angled to extend from the edge line of the front edges 12*a* and 12*b* toward the upstream side. Besides the aforementioned example, the turbine blade cascade structure may be formed such that only the wall surface 13*a* at the root side includes the downward inclined surface 19*a* linearly angled to extend from the edge line of the front edges 12*a* and 12*b* as shown in FIGS. 15 and 16, or only the wall surface 13*b* at the tip side includes the upward inclined surface 19*b* linearly angled to extend from the edge line of the front edges 12*a* and 12*b* as shown in FIGS. 17 and 18.

Figure 19:
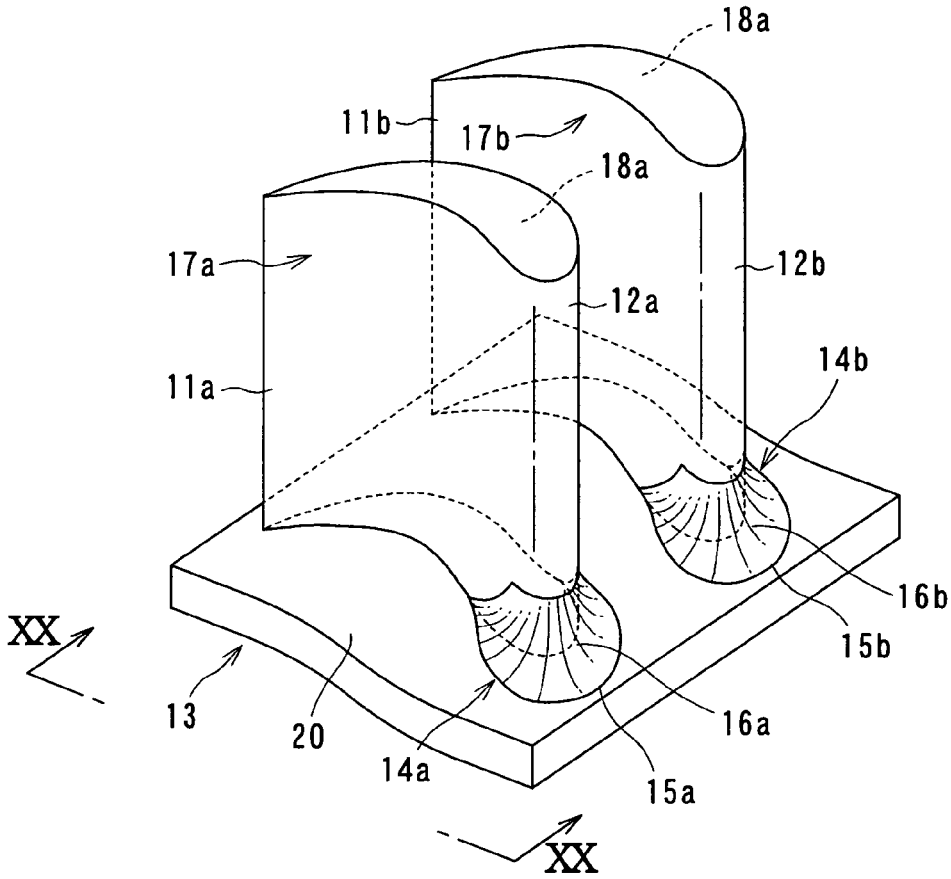
FIG. 19 is a conceptual view of a turbine blade cascade structure according to a tenth embodiment of the present invention.
Figure 20:
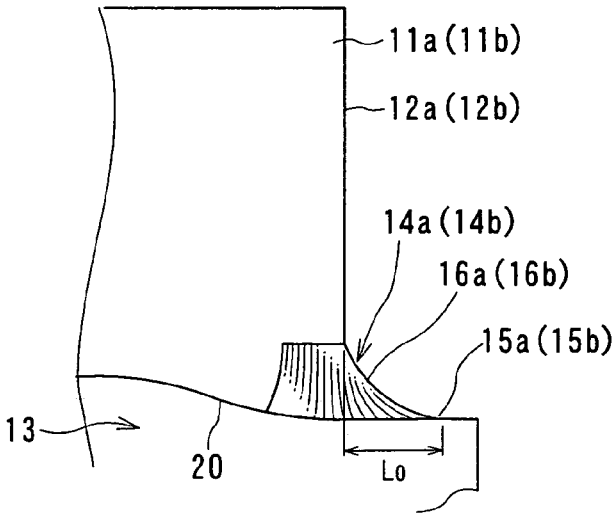
FIG. 20 is a side view of the turbine blade cascade structure seen from a direction XX-XX shown in FIG. 19.

FIGS. 19 and 20 are conceptual views of a turbine blade cascade structure according to a tenth embodiment of the present invention as an exemplary turbine rotor blade.

The elements of the embodiment which are the same as those of the second embodiment will be designated with the same reference numerals.

Likewise the second embodiment, in the turbine blade cascade structure according to the embodiment, the corner portions defined by the wall surface 13 like the turbine disc, and the front edges 12*a* and 12*b* of the adjacent blade bodies

11*a* and 11*b* on the wall surface 13 are provided with coatings 14*a* and 14*b* which extend therefrom toward the upstream side, have cross sections formed as protruded portions 16*a* and 16*b* each raised to the heights of the front edges 12*a* and 12*b* to form the concave curved surfaces, for example, and have fan-like configurations. The wall surface 13 for supporting the blade bodies 11*a* and 11*b* includes a downward inclined curved surface 20 curved from the line passing through each center of the width of the blade bodies 11*a* and 11*b* toward the upstream of the front edges 12*a* and 12*b*, respectively.

Since other elements and portions corresponding thereto in this embodiment are the same as those of the second embodiment, the overlapping explanation will be omitted.

In the embodiment, the front edges 12*a* and 12*b* of the blade bodies 11*a* and 11*b* are provided with fan-like coatings 14*a* and 14*b* which extend therefrom toward the upstream side, and have cross sections formed as the protruded portions 16a and 16*b* raised to the heights of the front edges 12*a* and 12*b* to form the concave curved surfaces, for example. The wall surface 13 for supporting the blade bodies 11*a* and 11*b* includes the downward inclined curved surface 20 curved from the line passing through each center of the width of the blade bodies 11*a* and 11*b*. Accordingly the flow rate of the working fluid flowing to the coatings 14*a*, 14*b*, and the inclined curved surface 20 is accelerated to force the horseshoe vortex away from the front edges 12*a* and 12*b*. Generation of the horseshoe vortex is suppressed to decrease the thickness of the boundary layer. This makes it possible to further reduce the secondary flow loss by diminishing the strength of the passage vortex.

Figure 21:
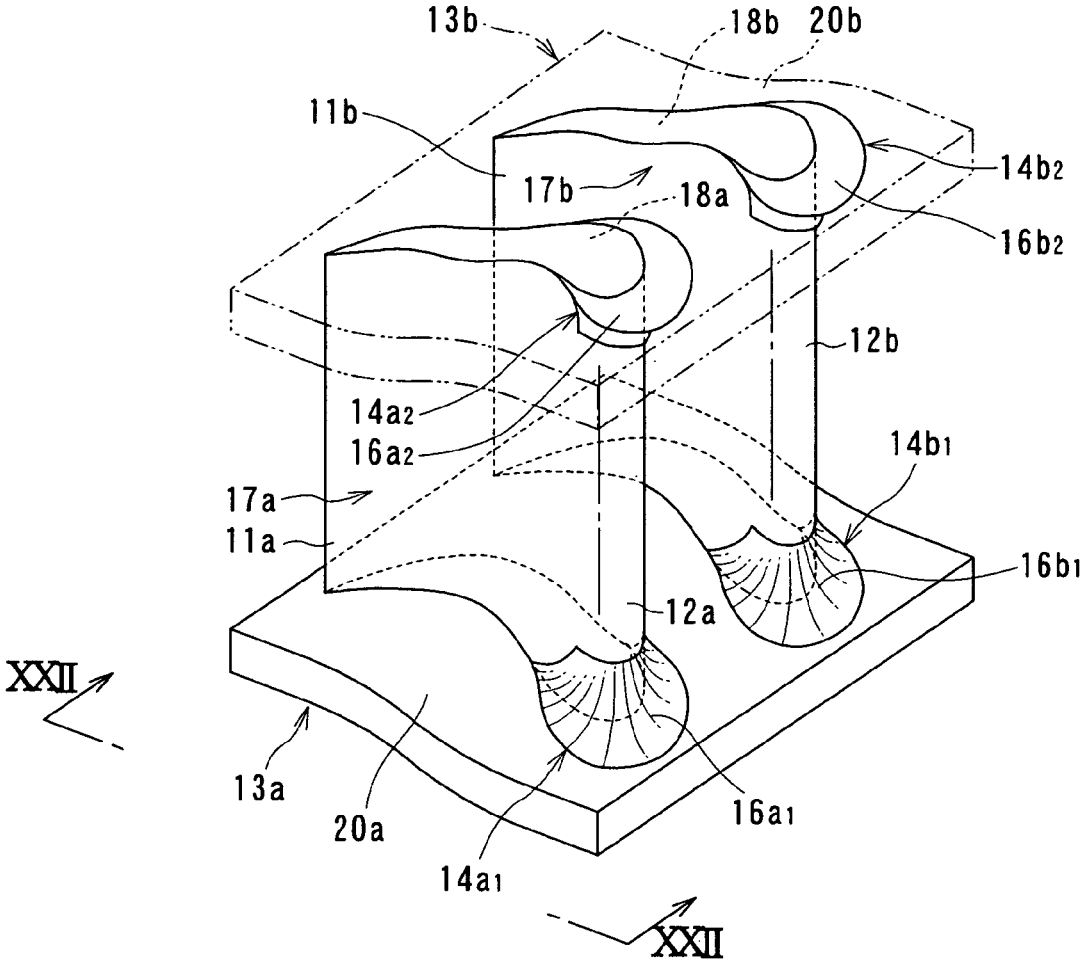
FIG. 21 is a conceptual view of a turbine blade cascade structure according to an eleventh embodiment of the present invention.
Figure 22:
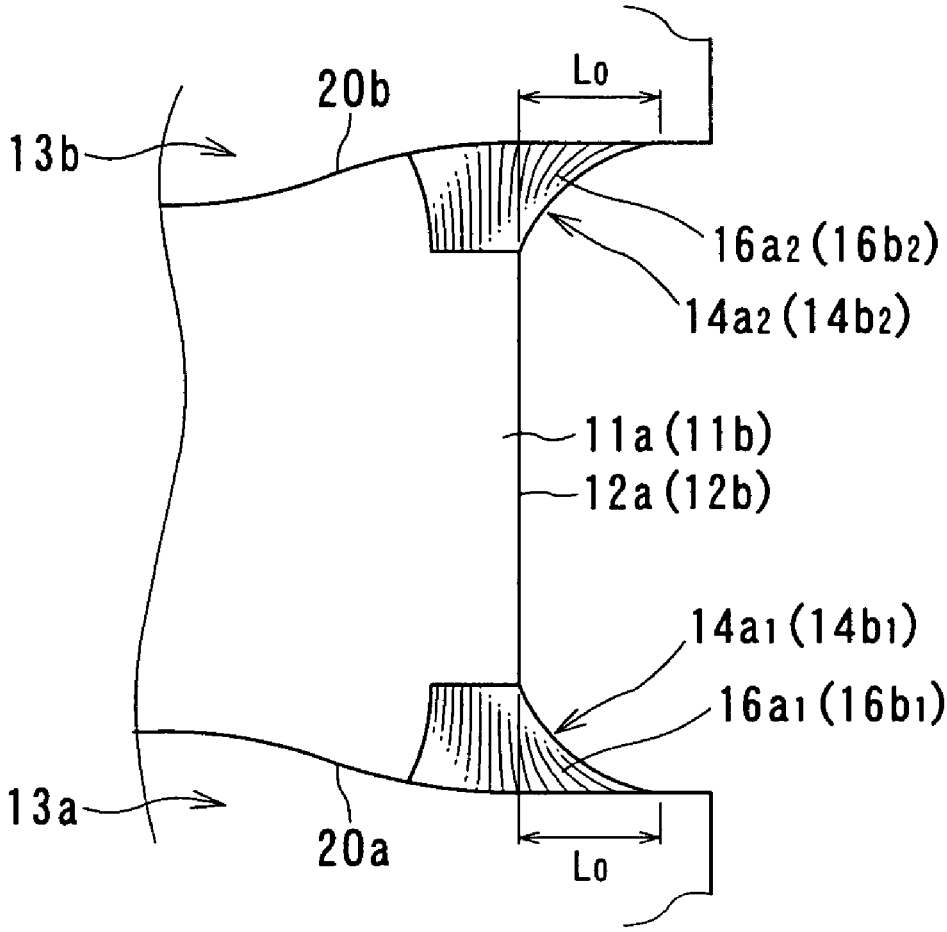
FIG. 22 is a side view of the turbine blade cascade structure seen from a direction XXII-XXII shown in FIG. 21.

The turbine blade cascade structure according to the embodiment is applied to the turbine rotor blade. However, it may be applied to the turbine nozzle (stationary blade). In this case, the turbine nozzle is structured such that corner portions defined by the wall surface 13*a* and the blade bodies 11*a* and 11*b* at the root side are provided with fan-like coatings $\mathbf{14}a_1$ and $\mathbf{14}b_1$, and the corner portions defined by the wall surface 13*b* and the front edges 12*a* and 12*b* of the blade bodies 11*a* and 11*b* at the tip side are provided with fan-like coatings $\mathbf{14}a_2$ and $\mathbf{14}b_2$ as shown in FIGS. 21 and 22.

Figure 23:
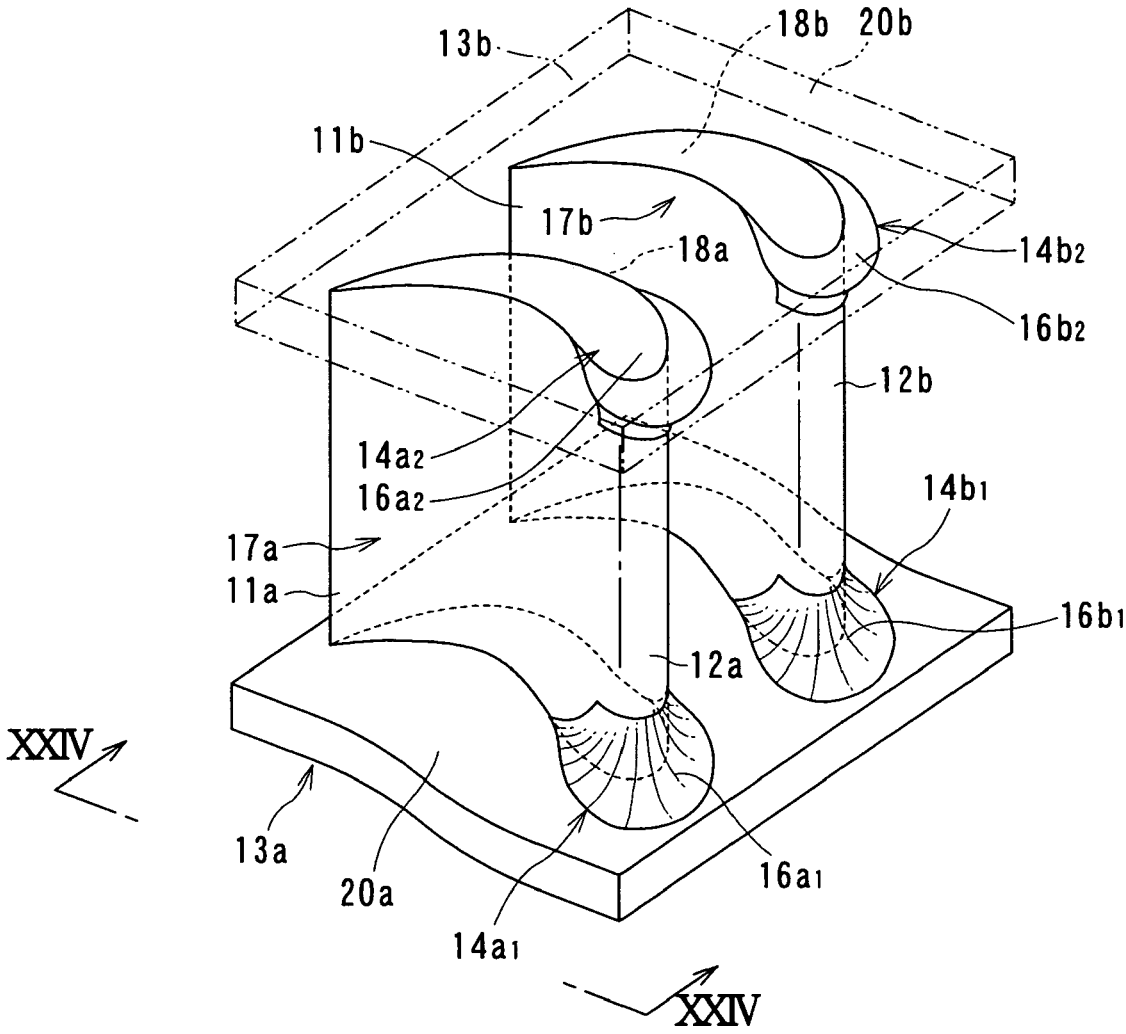
FIG. 23 is a conceptual view of a turbine blade cascade structure according to a twelfth embodiment of the present invention.
Figure 24:
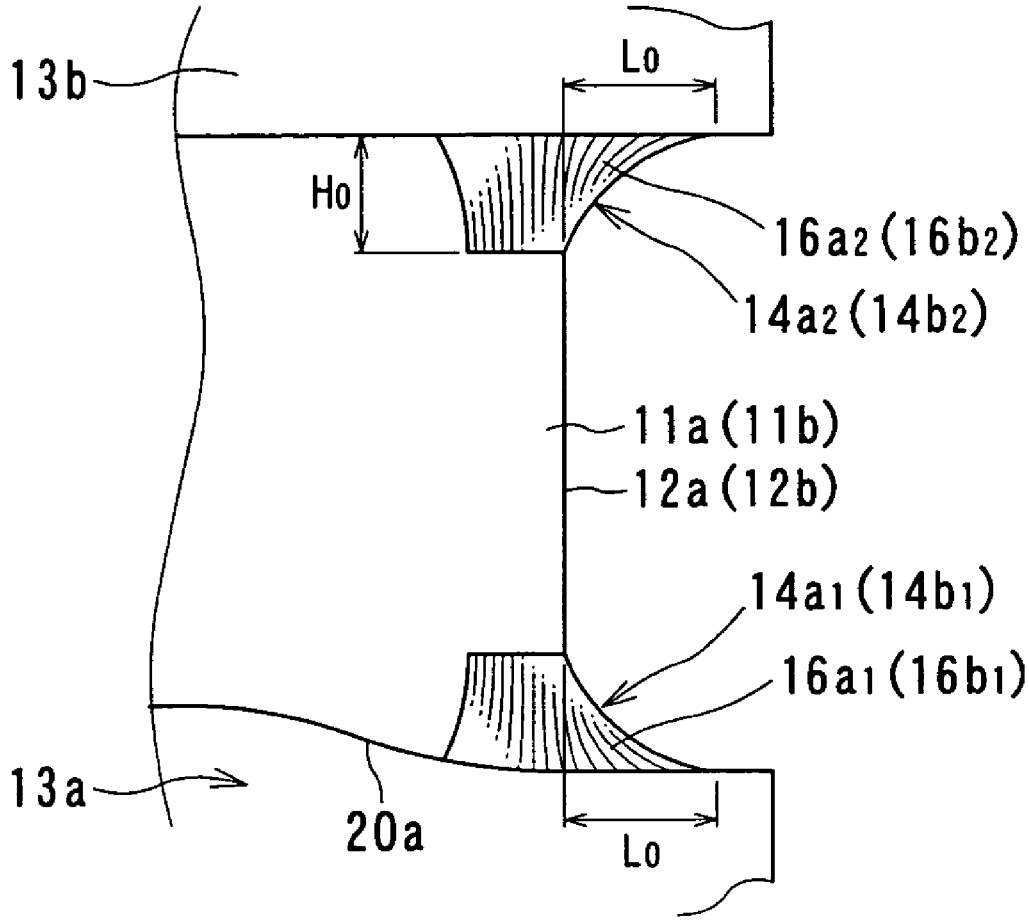
FIG. 24 is a side view of the turbine blade cascade structure seen from a direction XXIV-XXIV shown in FIG. 23.
Figure 25:
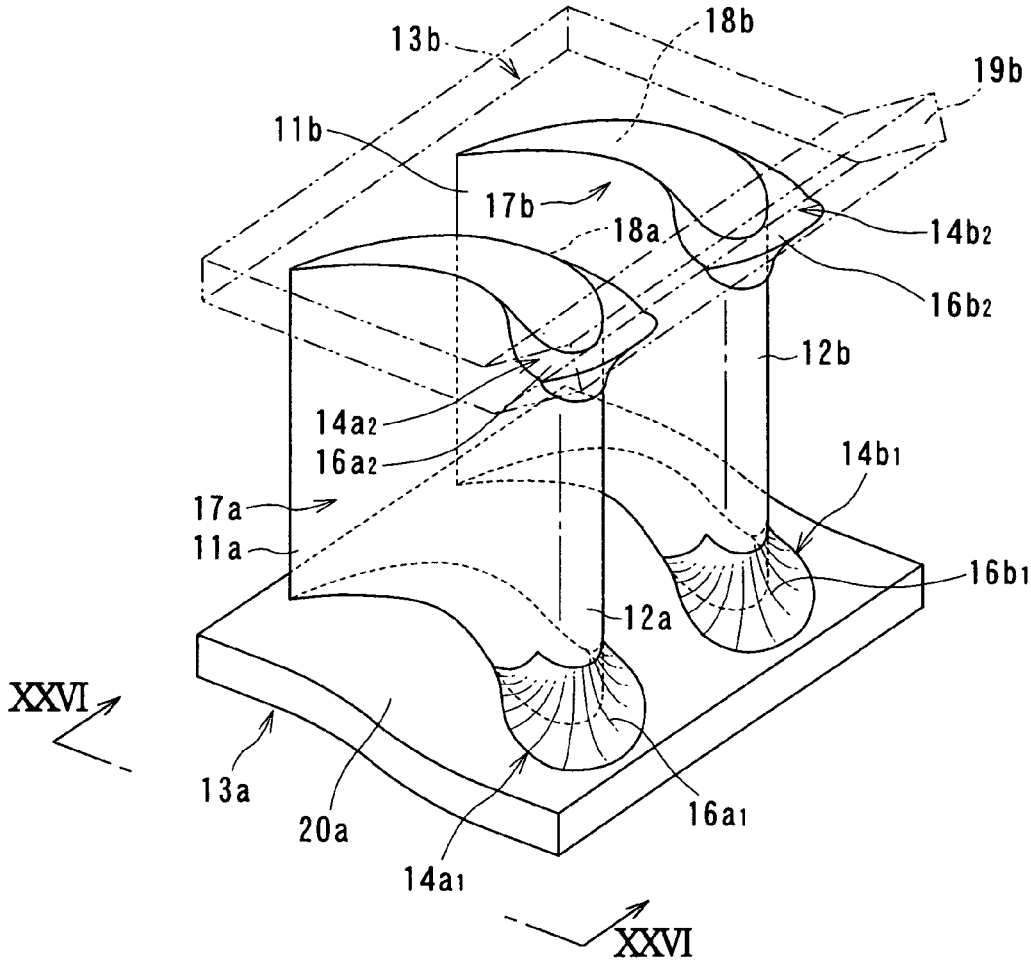
FIG. 25 is a conceptual view of a turbine blade cascade structure according to a thirteenth embodiment of the present invention.
Figure 26:
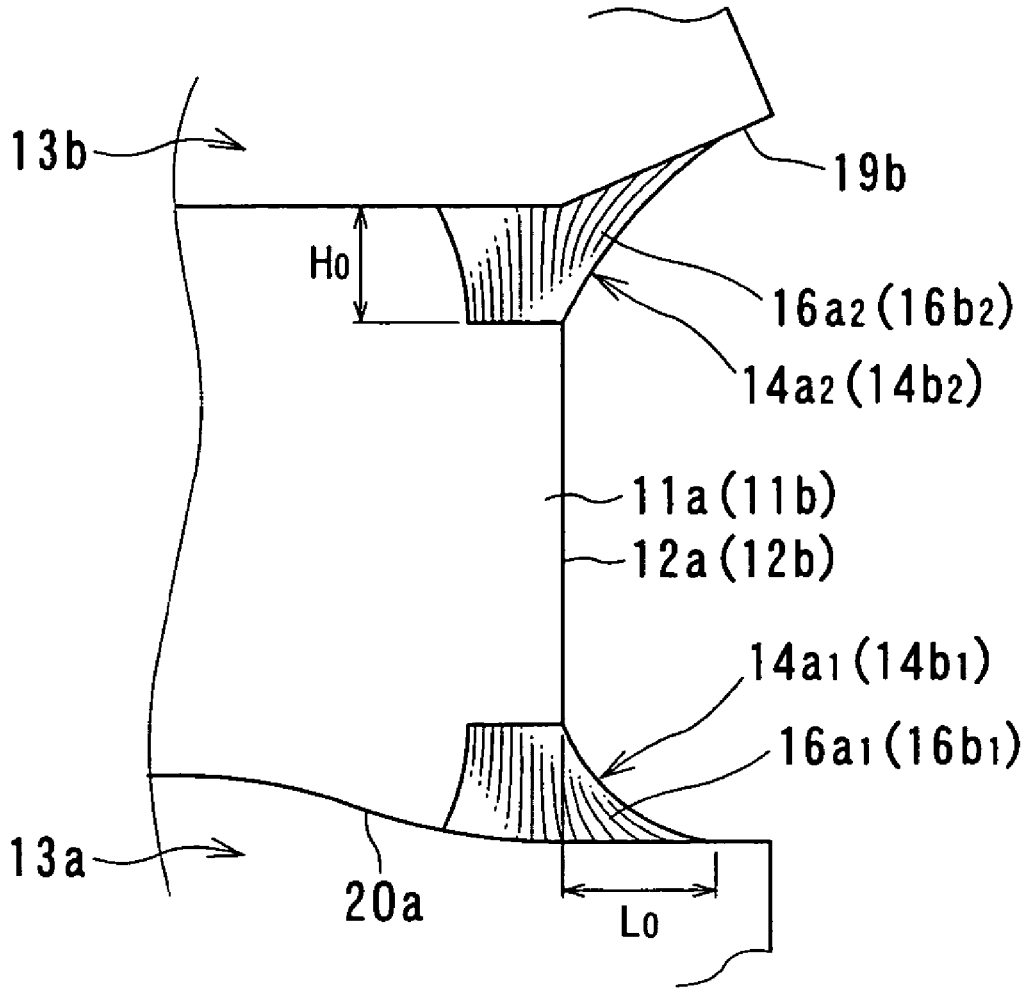
FIG. 26 is a side view of the turbine blade cascade structure seen from a direction XXVI-XXVI shown in FIG. 25.
Figure 27:
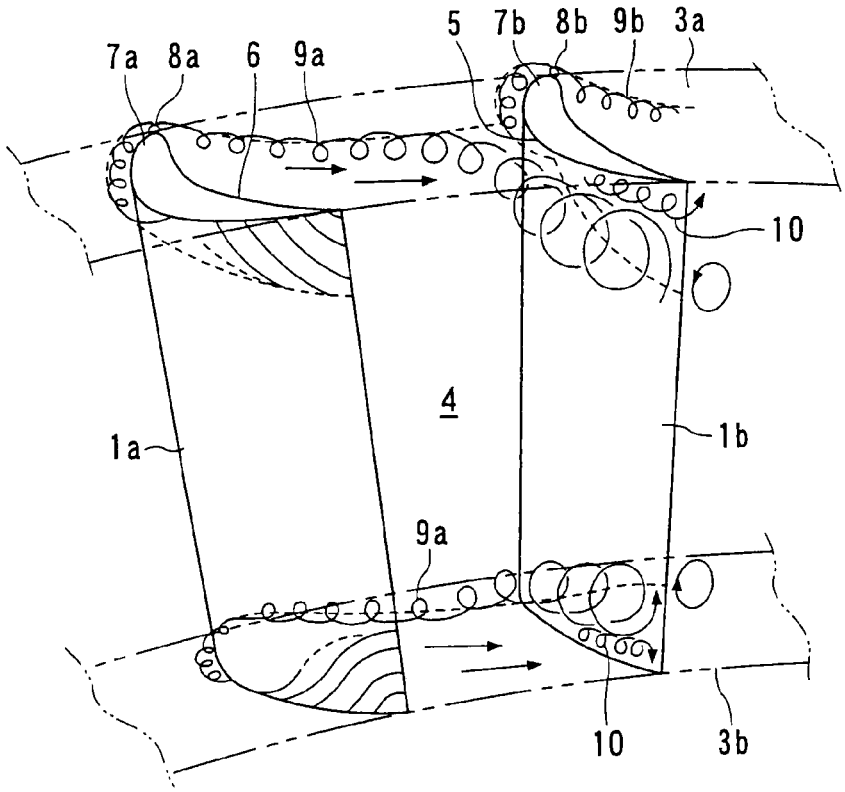
FIG. 27 is a conceptual view of a generally employed turbine blade cascade structure.
Figure 28:
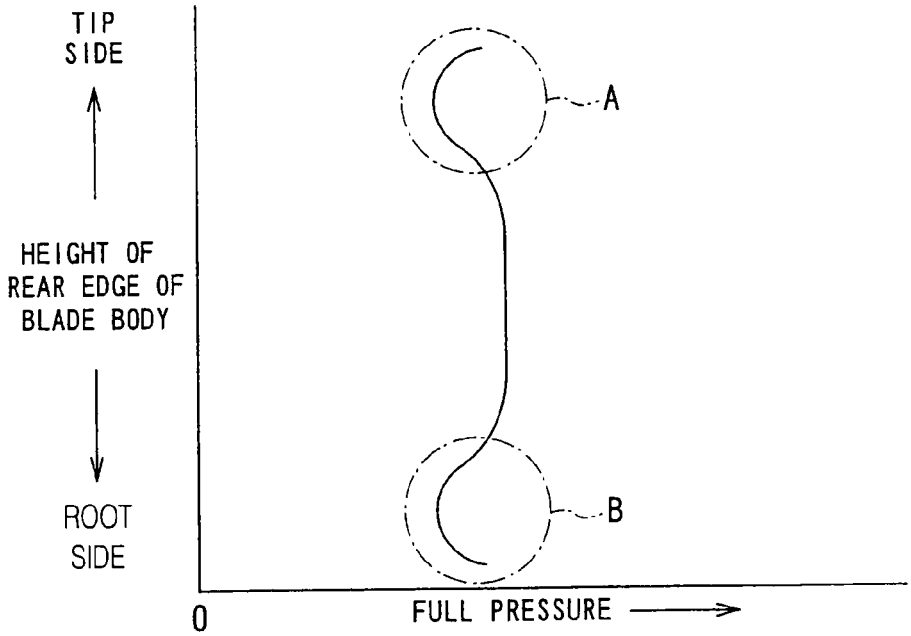
FIG. 28 is a diagrammatic view showing a secondary flow loss of the generally employed turbine blade cascade structure.

In the turbine nozzle according to the embodiment, both ends of the blade bodies 11*a* and 11*b* are supported by the wall surfaces 13*a* and 13*b*, respectively. The wall surfaces 13*a* and 13*b* for supporting the blade bodies 11*a* and 11*b* at the root and tip sides may be formed to include downward and upward inclined curved surfaces 20*a* and 20*b* each curved from the lines passing through each center of the width of the blade bodies 11*a* and 11*b* toward the upstream of the front edges 12*a* and 12*b* as shown in FIGS. 21 and 22. Among those wall surfaces 13*a* and 13*b* for supporting the blade bodies 11*a* and 11*b*, the wall surface 13*a* at the root side may include the downward inclined curved surface 20*a* curved from the line passing through each center of the width of the blade bodies 11*a* and 11*b* to the upstream of the front edges 12*a* and 12*b* as shown in FIGS. 23 and 24. Among those wall surfaces 13*a* and 13*b* for supporting the blade bodies 11*a* and 11*b*, the wall surface 13*a* at the root side may include a downward inclined curved surface 20*a* curved from the line passing through each center of the width of the blade bodies 11*a* and 11*b* to the upstream of the front edges 12*a* and 12*b*, and the wall surface 13*b* at the tip side may include an upward inclined surface 19 linearly angled to extend from the edge line of the front edges 12*a* and 12*b* to the upstream side as shown in FIGS. 25 and 26.

INDUSTRIAL APPLICABILITY

According to the present invention, the turbine blade cascade structure, a corner portion defined by a blade body and a wall surface is provided with a coating which has a cross section formed as a protruded portion to have a curved surface. The base portion of the protruded portion is extended toward the upstream side to enlarge the surface area such that the flow rate of the working fluid flowing to the protruded portion having the curved surface with enlarged surface area is accelerated to suppress generation of the horseshoe vortex from the front edge of the blade body. This makes it possible to further reduce the secondary flow loss by diminishing the strength of the passage vortex. The blade cascade structure according to the embodiment of the present invention may be applied to the rotor blade of the turbine, and the stationary blade, for example, which is industrially effective for further reducing the secondary flow loss by diminishing the strength of the passage vortex through the flow of the working fluid.

The invention claimed is:

1. A turbine blade cascade structure comprising:

a plurality of blades having respective blade bodies and provided in series on a wall surface in a circumferential direction, the wall surface connecting the blade bodies so that connected portions of the wall surface and blade bodies form corner portions, respectively; and a cover portion disposed only at a portion near a front edge portion of each of the blade bodies corresponding to a flow of a working fluid in the corner portions formed to the connected portion, extending to an upstream side of the flow of the working fluid and formed as a protruded portion having a concave curved surface toward a height direction of the front edge portion of the blade body from a base portion on the upstream side of the flow of the working fluid, wherein the protruded portion having the concave curved surface is formed to establish relationships of L0=(2-5) H0 and H0=(0.5-2.0)T, in which L0 represents a distance from the base portion to the front edge portion of the blade body, H0 represents a distance from the wall surface to the height direction of the front edge portion, and T represents a thickness of a boundary layer of the working fluid in a steady operation.

2. The turbine blade cascade structure according to claim 1, wherein at least one of a root side and a tip side of the blade body is provided with the cover portion.

3. The turbine blade cascade structure according to claim 1, wherein the protruded portion having the concave curved surface is formed into a fan-like configuration that extends to a front side and a back side of the blade body with respect to a stagnation point in a steady operation of the working fluid that collides against the front edge portion of the blade body.

4. The turbine blade cascade structure according to claim 3, wherein an angle θ of a sector of the protruded portion having the fan-like configuration with respect to the stagnation point in the steady operation of the working fluid that meets against the front edge portion of the blade body is set to be in a range between ±15° and ±60°.

5. The turbine blade cascade structure according to claim 1, wherein the protruded portion is raised from the upstream side to the height direction of the front edge portion of the blade body, the protruded portion formed by selecting one of a connecting piece that has been preliminarily made as an independent member, a machined piece together with the blade body, and a welded deposit.

6. The turbine blade cascade structure according to claim 1, wherein the blade bodies are supported by at least one of the wall surface at a root side of the blade bodies and the wall surface at a tip side of the blade bodies.

7. The turbine blade cascade according to claim 1, wherein the blade bodies are connected to the wall surface at a root side of the blade bodies, and the wall surface on the root side is formed as a straight downward inclined surface from the front edge portion of the blade bodies toward the upstream side as viewed from the front side of the blade bodies.

8. The turbine blade cascade according to claim 6, wherein the blade bodies are connected to the wall surface at the root side, and the wall surface on the root side is formed as a downward inclined curved surface from an intermediate portion of the blade bodies toward the upstream side of the front edge portion as viewed from the front side of the blade bodies.

9. The turbine blade cascade according to claim 1, wherein the blade bodies are connected to the wall surface at a tip side thereof, and the wall surface on the tip side is formed as an upward inclined surface and an upward inclined surface from the front edge portion of the blade bodies as viewed from the front side of the blade bodies.

10. The turbine blade cascade structure according to claim 1, wherein the blade bodies are connected to the wall surface at a tip side of the wall surface, and the wall surface on the tip side is formed as an upward inclined curved surface curved from an intermediate portion of the blade bodies toward the front edge portion of the upstream side.

11. The turbine blade cascade structure according to claim 1, wherein the wall surface for connecting the blade bodies is flat.

12. The turbine blade cascade structure according to claim 1, wherein the protruded portion forming the cover portion is formed from a single concave curved surface.

* * * * *